US010001011B2

(12) United States Patent
Schneeberger

(10) Patent No.: US 10,001,011 B2
(45) Date of Patent: Jun. 19, 2018

(54) ROTARY PISTON ENGINE WITH OPERATIONALLY ADJUSTABLE COMPRESSION

(76) Inventor: Johannes Peter Schneeberger, Brisbane, CA (US)

( * ) Notice: Subject to any disclaimer, the term of this patent is extended or adjusted under 35 U.S.C. 154(b) by 1708 days.

(21) Appl. No.: 12/564,877

(22) Filed: Sep. 22, 2009

(65) Prior Publication Data

US 2011/0023815 A1 Feb. 3, 2011

Related U.S. Application Data

(63) Continuation-in-part of application No. 12/534,815, filed on Aug. 3, 2009, now Pat. No. 8,434,449.

(51) Int. Cl.

| | |
|---|---|
| ***F02B 53/00*** | (2006.01) |
| ***F02B 53/02*** | (2006.01) |
| ***F02B 53/04*** | (2006.01) |
| ***F01C 1/07*** | (2006.01) |

(52) U.S. Cl.

CPC ..... *F01C 1/07* (2013.01); *F02B 53/00* (2013.01); *F02B 53/02* (2013.01); *F02B 53/04* (2013.01); *F04C 2240/603* (2013.01)

(58) Field of Classification Search

CPC ..... Y02T 10/17; F02B 53/02; F02B 53/00; F02B 57/00

USPC ..... 123/245, 241, 43 B, 18 R, 18 A; 418/35–38; 60/39.6–36.63

See application file for complete search history.

(56) References Cited

U.S. PATENT DOCUMENTS

| | | | | | |
|---|---|---|---|---|---|
| 1,729,242 | A | * | 9/1929 | Bregere | 123/43 B |
| 2,132,595 | A | * | 10/1938 | Bancroft | 123/559.1 |
| RE24,064 | E | * | 9/1955 | Welch | 418/265 |
| 3,073,118 | A | * | 1/1963 | August | 123/213 |
| 3,227,090 | A | * | 1/1966 | Bartolozzi | 123/245 |
| 3,256,866 | A | * | 6/1966 | Bauer | 123/245 |
| 3,518,975 | A | * | 7/1970 | Schmidt | 123/210 |

(Continued)

FOREIGN PATENT DOCUMENTS

| | | | | |
|---|---|---|---|---|
| DE | 4411636 | A1 * | 10/1995 | F01C 1/00 |
| EP | 1681437 | A1 * | 7/2006 | F01C 1/07 |

(Continued)

*Primary Examiner* — Mary A Davis

(74) *Attorney, Agent, or Firm* — IDEPA Inc

(57) ABSTRACT

Axially protruding and centrally cool able pistons rotate within a cylindrical main chamber. Each piston is individually kinetically linked to a flywheel. As the pistons are individually accelerated and decelerated along their continuous rotating path, rotating volumes between them angularly expand and contract. Inlets and outlets communicate fluid in correspondence with expansion and contraction phases of the rotating volumes. A low number of moving parts, area sealed volumes, no valves, balanced mass forces, smooth rotation and short force transmission paths between opposing mass forces provide for lightweight construction and high rotational speeds. Radial sliding secondary pistons of the kinetic linkage modulate secondary rotating volumes adjacent the main chamber for a dual stage thermodynamically efficient engine operation with intermittent fluid cooling or heating. Inlets and/or outlets may be angularly changed for variable compression and/or combustion engine peak pressures, expansion end pressure, for brake energy recycling and burst mode engine operation.

6 Claims, 26 Drawing Sheets

(56) References Cited

U.S. PATENT DOCUMENTS

| | | | | |
|---|---|---|---|---|
| 3,867,912 | A * | 2/1975 | Parr et al. | 123/238 |
| 3,883,277 | A | 5/1975 | Keller | |
| 4,024,841 | A * | 5/1977 | Smith | 123/241 |
| 4,068,985 | A * | 1/1978 | Baer | 418/36 |
| 4,122,669 | A * | 10/1978 | Hubers | 60/39.63 |
| 4,335,684 | A * | 6/1982 | Davis | 123/23 |
| 4,760,701 | A * | 8/1988 | David | 60/595 |
| 5,381,766 | A * | 1/1995 | Sakita | 123/245 |
| 5,569,027 | A | 10/1996 | Ball et al. | |
| 6,341,590 | B1 * | 1/2002 | Barrera et al. | 123/245 |
| 6,397,579 | B1 * | 6/2002 | Negre | 60/39.6 |
| 6,544,020 | B1 * | 4/2003 | Bahnen et al. | 418/88 |
| 6,880,484 | B1 | 4/2005 | Lee | |
| 6,886,527 | B2 | 5/2005 | Regev | |
| 6,895,922 | B1 | 5/2005 | Stoughton et al. | |
| 6,962,137 | B2 | 11/2005 | Udy | |
| 7,156,068 | B2 | 1/2007 | Yuksel | |
| 7,178,502 | B2 | 2/2007 | Okulov | |
| 7,222,601 | B1 | 5/2007 | Kamenov | |
| 7,255,086 | B2 | 8/2007 | Kovalenko | |
| 7,285,144 | B2 * | 10/2007 | Nagato et al. | 48/198.6 |
| 7,341,041 | B2 | 3/2008 | Pekau | |
| 7,347,676 | B2 | 3/2008 | Kopelowicz | |
| 7,364,415 | B2 | 4/2008 | Day | |
| 7,415,962 | B2 * | 8/2008 | Reisser | 123/245 |
| 7,431,007 | B2 | 10/2008 | Kamath | |
| 7,441,534 | B2 * | 10/2008 | Bastian | 123/245 |
| 7,461,626 | B2 | 12/2008 | Kimes | |
| 7,849,822 | B2 * | 12/2010 | Yim | 123/18 R |
| 7,909,590 | B2 * | 3/2011 | Pomar | 123/18 R |
| 2004/0128974 | A1 * | 7/2004 | Laper | 60/39.6 |
| 2007/0199299 | A1 * | 8/2007 | Kashmerick | 60/39.6 |
| 2007/0235002 | A1 * | 10/2007 | Blank | 123/275 |

FOREIGN PATENT DOCUMENTS

| | | | |
|---|---|---|---|
| FR | 2439884 | A * | 6/1980 |
| FR | 2691206 | A * | 11/1993 |

* cited by examiner

ROTARY PISTON ENGINE WITH OPERATIONALLY ADJUSTABLE COMPRESSION

The present application is a Continuation in Part Patent Application of the same Title and Inventor filed Aug. 3, 2009, now U.S. Pat. No. 8,434,449 application Ser. No. 12/534,815.

FIELD OF INVENTION

The present invention relates to pumps, compressors and engines with circumferential undulating, area sealed rotating pistons.

BACKGROUND OF INVENTION

Piston devices are preferably used where a large fluid pressure difference needs to be induced or utilized. Commonly employed linearly oscillating piston pumps, compressors and engines are well known for their mechanical friction losses, fluid friction losses and thermodynamic losses. Mechanical friction losses particularly in engines are attributed to the commonly large number of valves, pistons and their driving and linking mechanisms and the friction in between them. Fluid friction losses occur predominantly across intake and exhaust valves. Thermodynamic losses are contributed by the initial fluid compression taking place in the hot combustion chamber where the working fluid under compression is additionally heated from outside. As the working fluid also heats up internally during its compression, the compression ratio is reduced by the external heating in a gasoline engine by the self ignition temperature of the gasoline vapors. In a diesel engine well known chemical reaction temperatures limit the maximum compression ratio. Thermodynamic efficiency is directly related to compression ratio as is well known in the art. Therefore there exists a need for a piston device that may be utilized as a pump, compressor and/or in a combustion engine and that provides reduced mechanical friction losses due to a reduced number of moving parts, reduced fluid friction losses due to a fluid exchange control without valves and in case of a combustion engine reduced thermodynamic losses due to a compression stage that is structurally separated from combustion heated structures. The present invention addresses these needs.

The concept of a rotating volume that contracts and expands while moving in a loop has been considered in the prior art to provide fluid exchange without valves. The well known Wankel engine is the only mass produced rotating piston combustion engine to date. Despite its compact design without valves, it has the fundamental flaw of a line contact seal that slides along an abruptly changing peripheral surface with high velocity. This limits live time as well as compression ratio. Therefore, there exists a need for a rotating piston engine that provides area sealing in between continuously shaped sealing surfaces for a reliable lasting operation. The present invention addresses also this need.

Other prior art rotating piston engine concepts provide work volumes that expand and contract while rotating. These engine concepts fail on one hand to address the particular needs for a simple mechanical drive with low number of joints and shortest mechanical force transmitting paths that can be designed with sufficient strength and stiffness and yet with minimal moving mass and mass forces. Also it is desirable to have all moving masses at a minimum and substantially balanced to minimize vibration and bearing loads at high rotational speeds. This is one well known prerequisite to drive such devices with sufficiently high rotational speeds in order to obtain a power to weight ratio of such an engine that is at least comparable with that of a modern oscillating piston engine. Therefore, there exists a need for a rotating piston device that is mechanically simple with a low number of lightweight moving parts. and with substantially balanced rotating masses for high rotational speeds and consequently for a high power to weight ratio. The present invention addresses also this need.

On the other hand, to employ a rotary piston device in conjunction with hot combusting fluids, there is a need to provide the pistons particularly with a sufficiently loose connection, cooling and lubrication so that they their thermal expansion and sliding friction may be conveniently controlled. At the same time pistons and other parts contributing in encapsulating the work volumes are desired to have area contact in the sliding seal interfaces. This is another prerequisite for reliable sealing at high pressures, minimized wear and optimized heat transfer in the sliding seal interfaces. The present invention addresses also these needs.

SUMMARY

Preferably two axially protruding rotary pistons are commonly rotationally guided and individually angularly accelerated within a common cylindrical piston chamber. As the rotary pistons individually and alternately accelerate and decelerate during their rotation around a stationary primary rotation axis, work volumes between them angularly expand and contract. Inlets along the piston chamber provide peripheral access of a work fluid to the work volumes as the expanding work volumes pass by the inlets. As the contracting work volumes pass by the outlets, the contained work fluid is vacated into the outlets. Angular position and extension of the inlet(s) and outlet(s) are selected in conjunction with the intended use of the rotary piston device as a pump, compressor or as a motor as may be well appreciated by anyone skilled in the art.

Each rotary piston is part of a rotary assembly that includes crank disks axially coupled to the rotary pistons at both their axial ends. Each crank disk has a crank joint with a tertiary rotation axis fixed with respect to their rotary piston and in a secondary offset to the primary rotation axis. Joined at the crank joints are driving pistons that rotate freely around their respective tertiary rotation axes and together with their rotary assembly around the primary rotation axis. Each driving piston in turn is radial free guided in a radial sliding guide of flywheels outward and immediately adjacent to both crank disks. The flywheels with their sliding guides rotate around a stationary secondary rotation axis that is in a primary offset to the primary rotation axis. Due to the primary offset, the driving pistons are forced radial inward and outward in their radial sliding guides as they are rotated by the radial sliding guides around the secondary rotation axis. The changing distance of the driving pistons to the secondary rotation axis results in a varying rotational speed of them together with the joined rotary assemblies around the primary rotation axis while the flywheels rotate at a substantially constant speed. The tertiary rotation axes compensate for a periodically changing angle of the driving pistons relative to their respective rotary assemblies.

The sliding guides of opposite flywheels are aligned with each other and each of them extends preferably continuous across the secondary rotation axis. Driving pistons belonging to separate rotary assemblies are guided in the radial sliding guides on opposite sides of the secondary rotation axis. Thus, the two rotary assemblies and their driving pistons are accelerated and decelerated individually and in an alternating fashion. As a favorable result, the angular mass forces resulting from angular acceleration and deceleration of the two rotary assemblies and their joined driving pistons are substantially cancelled out in the radial sliding guides and have no substantial effect on the continuous rotation of the flywheels.

The driving pistons may be joined with their crank disks diametrically opposite the rotary piston with respect to the primary rotation axis. Consequently, a combined mass center of each rotary assembly and its respective driving pistons may be positioned coinciding with the primary rotation axis. Centrifugal mass forces of individual rotary assembly components and their respective driving pistons may thereby cancel itself out.

The rotary piston device provides a low number of rotating parts, area sealing interfaces between pistons and their contacting faces, fluid exchange without valves, balanced centrifugal and angular mass forces, short force transmission paths between joined and coupled components of individually opposing mass forces and smooth rotation. As a consequence, the rotary piston device may be operated reliable and efficiently at high rotational speeds, which in turn provides for a high power to weight ratio.

The rotary piston device may be part of a combustion engine providing compression of ambient air and/or air/fuel mixture and in an additional separate stage a motor that is harvesting at least the pressure energy but eventually also the kinetic energy of the pressurized combusted and/or combusting air and/or air fuel mixture. The rotary piston device may also be operated as a pump or motor of incompressible fluid, and/or as a compressor or motor for compressible fluid.

The rotary piston device may be configured as a compression stage and expansion stage that may be linked for gas transfer with an in between combustion system. In an engine, the compression stage and expansion stage may be individually scaled such that the overall expansion volume is substantially larger than the compression volume for extensive pressure harvesting of the combusted fuel air mixture. A single compression stage may also be combined with two or more separate expansion stages that may be individually connect and disconnect able to the combustion system for efficient part load operation and extensive pressure harvesting.

Inlets and/or outlets of the compression stage(s) and/or the expansion stage(s) may be adjustable in their angular extension around the primary pistons' rotation axes. In that way, compression ratio on the compression stage(s) and expansion ratio on the expansion stage(s) may be modulated for tuning the combustion process, brake energy recycling and/or burst mode engine operation in conjunction with an air container of a sufficient size to provide additional pressurized air flow into a following combustion chamber for a limited period of burst mode operation of the combustion engine.

The compression stage(s) and expansion stage(s) may be either directly rotationally coupled or via an angle modulating gear linkage that provides a variable angular offset between the compression stage(s) and expansion stage(s) to modulate the fluid exchange timing of compression stage(s) and expansion stage(s) with respect to each other.

DETAILED DESCRIPTION

Figure 1:
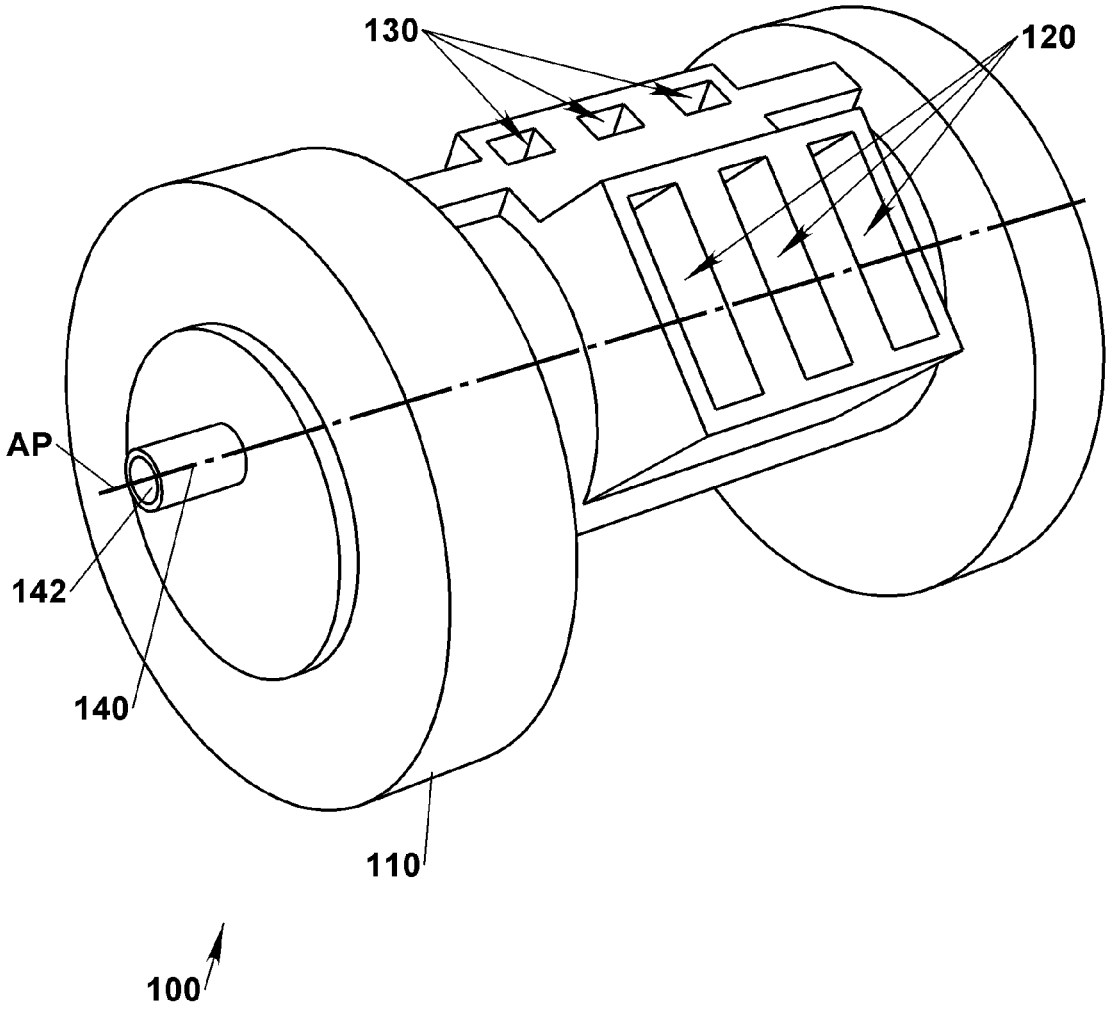
FIG. 1 is a first perspective view of rotary piston device of a first embodiment of the invention.
Figure 2:
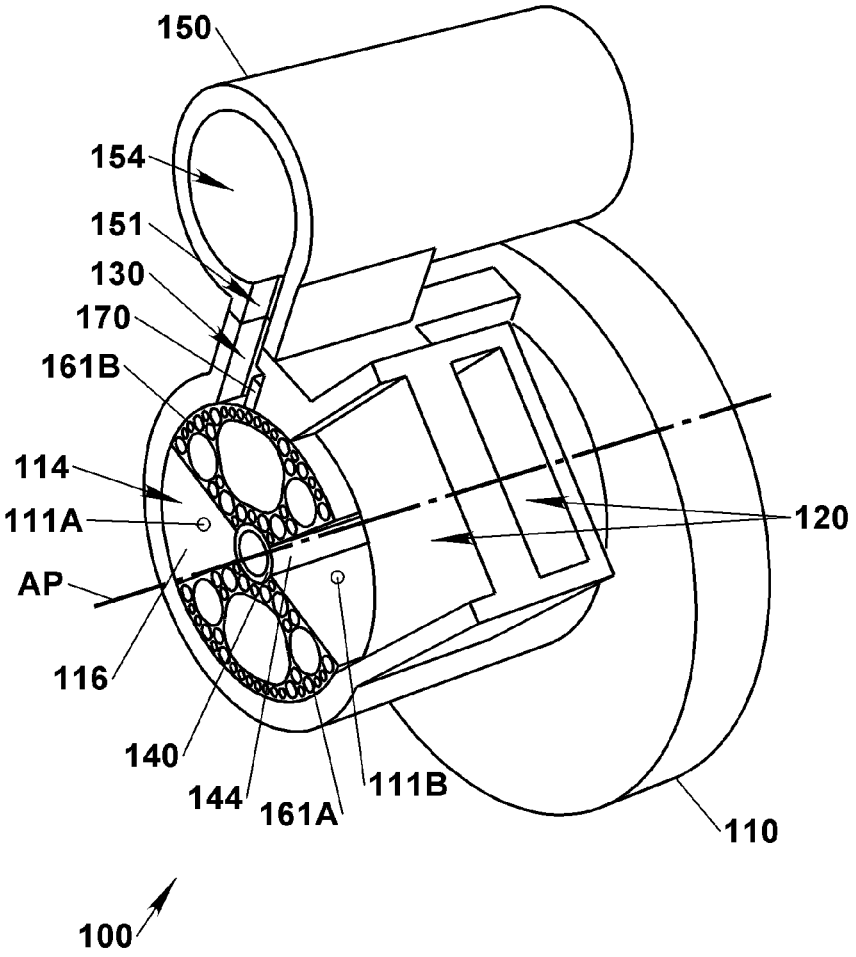
FIG. 2 is the first perspective view of the rotary piston device of FIG. 1 cut along a vertical mid side plane.
Figure 3:
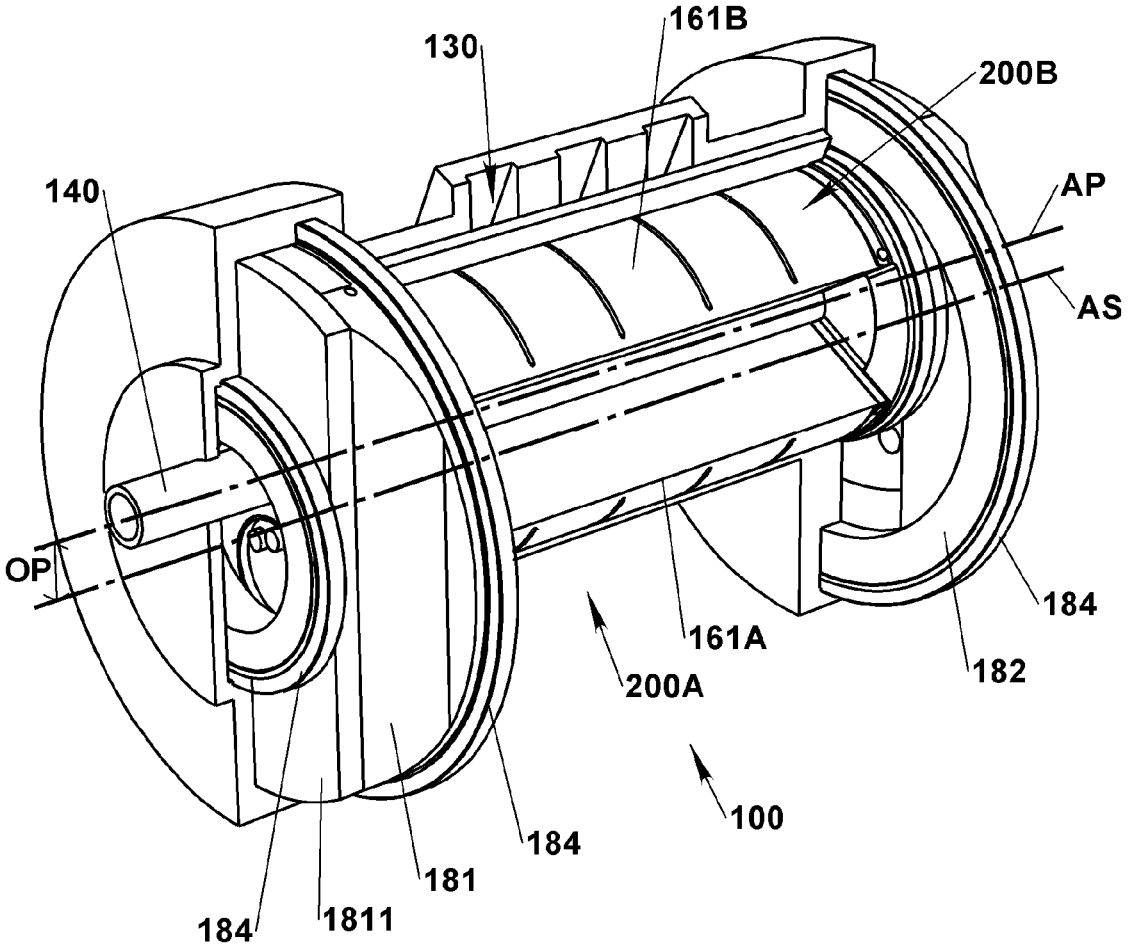
FIG. 3 is the first perspective view of the rotary piston device of FIG. 1 with the housing cut along a vertical mid front plane.
Figure 4:
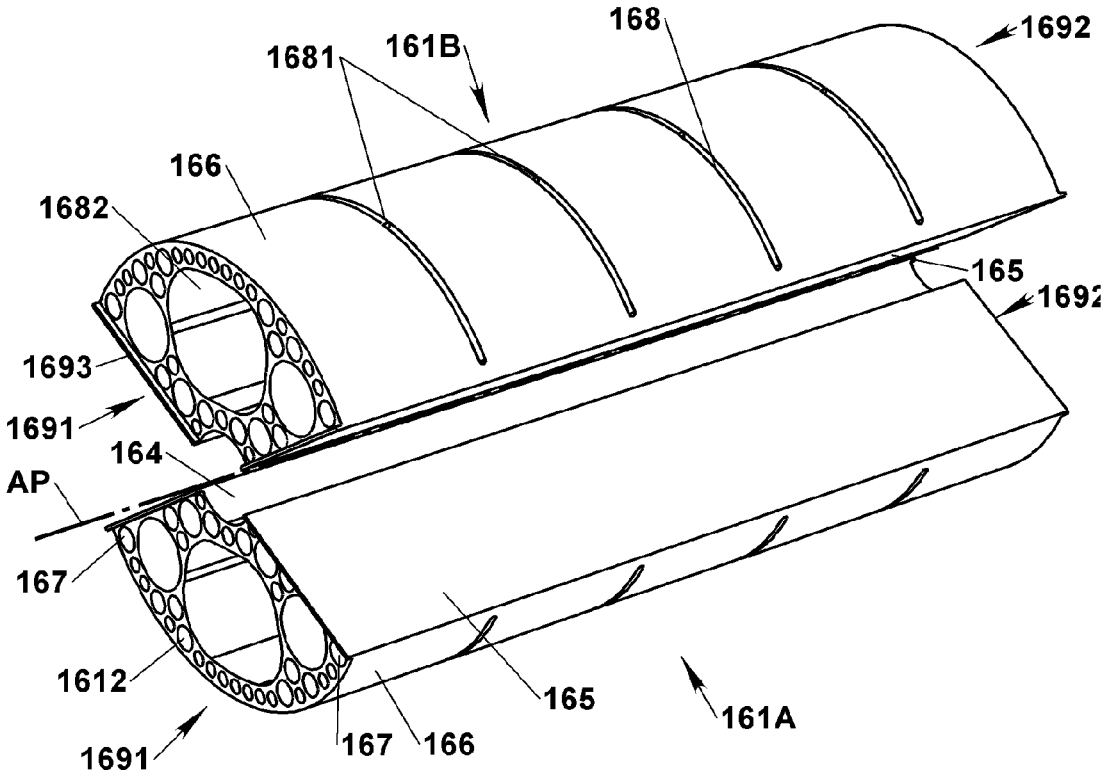
FIG. 4 is the first perspective view of rotary pistons of a first embodiment of the rotary piston device as in FIGS. 1, 2, 3.
Figure 5:
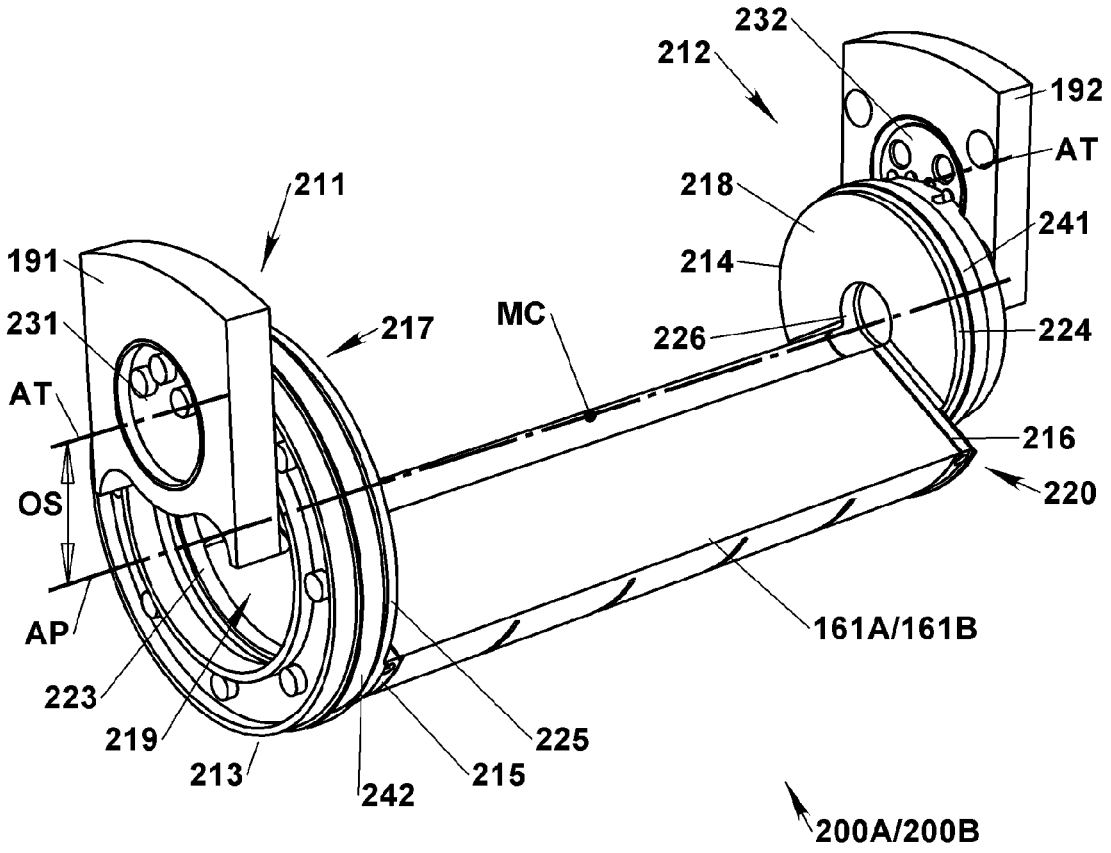
FIG. 5 is the first perspective view of a rotary assembly including one rotary piston of FIG. 4.

As in FIGS. 1-6, a rotary piston device 100 of a first embodiment of the invention includes a housing 110 having inside a primary piston chamber 114. The primary piston chamber 114 is rotationally symmetric with respect to a primary rotation axis AP, which is stationary with respect to the housing 110. The primary piston chamber 114 is preferably cylindrical. Also part of the rotary piston device 100 are preferably two rotary assemblies 200A, 200B suspended concentrically to each other, two opposing flywheels 181, 182, and two opposing driving pistons 191, 192 at each of the rotary assemblies 200A, 200B. The rotary assembly 200A, 200B are rotationally suspended with respect to the primary rotation axis AP within the primary piston chamber 114. Part of each rotary assembly 200 is a rotary piston 161A/161B axially extending along the primary rotation axis AP between two opposing axial piston ends 1691, 1692 and two opposing crank disks 211,212. Each of the crank disks 211/212 has an axial piston coupling 215/216, a crank joint 231/232 and a bearing disk 213/214 that is in between a respective axial piston coupling 215/216 and a respective crank joint 231/232. Each bearing disk 213/214 has chamber seal face 217/218 that contributes in axially sealing the primary piston chamber 114 and that is in a sliding seal contact with an opposite piston coupling back face 220/219. The axial piston couplings 215,216 are axially engaging with a respective one of the opposing piston ends 1691/1692 such that torque, fluid pressure on the rotary pistons 161A, 161B as well as mass forces of the rotary pistons 161A, 161B are transferred onto the adjacent crank disks 211, 212 while the rotary pistons 161A, 161B remain preferably axially loose in between the opposing axial piston couplings 215, 216. In that way, the rotary pistons 161A, 161B may freely axially expand when heated by a compressed and/or combusting fluid in the adjacent work volumes 111A, 111B. Each of the crank joints 231,232 provides a tertiary rotation axis AT that is fixed with respect to the respective rotary assembly 200. The tertiary rotation axes AT are in a secondary offset to the primary rotation axis AP. The rotary pistons 161A, 161B are axially flush with each other. A secondary bearing disk 214 of one the two rotary assemblies 200A, 200B is rotationally suspended inside a primary bearing disk 213 of one other of the two rotary assemblies 200A, 200B preferably via a disk interconnect bearing 241. The bearing disks 213, 214 have radial seal faces 223, 224 in rotating seal contact with each other. The primary bearing disk 213 has also peripheral seal face 225 in rotating seal contact with the housing 100. Seal faces 223, 224, 225 contribute in axially sealing the primary piston chamber 114.

Each of the rotary pistons 161A/161B features angled piston faces 165, a center face 164, and a peripheral face 166 with optional lubrication grooves 168. The peripheral face 166 provides preferably circumferential area contact sealing with a primary peripheral wall 116 of the primary piston chamber 114. Nevertheless and as may be well appreciated by anyone skilled in the art, the peripheral face 166 may feature other well known sealing features. Likewise, the center face 164 may be in a circumferential area contact sealing with a central seal wall 144 provided by a center tube 140. Optional well known seal features may also be employed on the center face 164.

Figure 6:
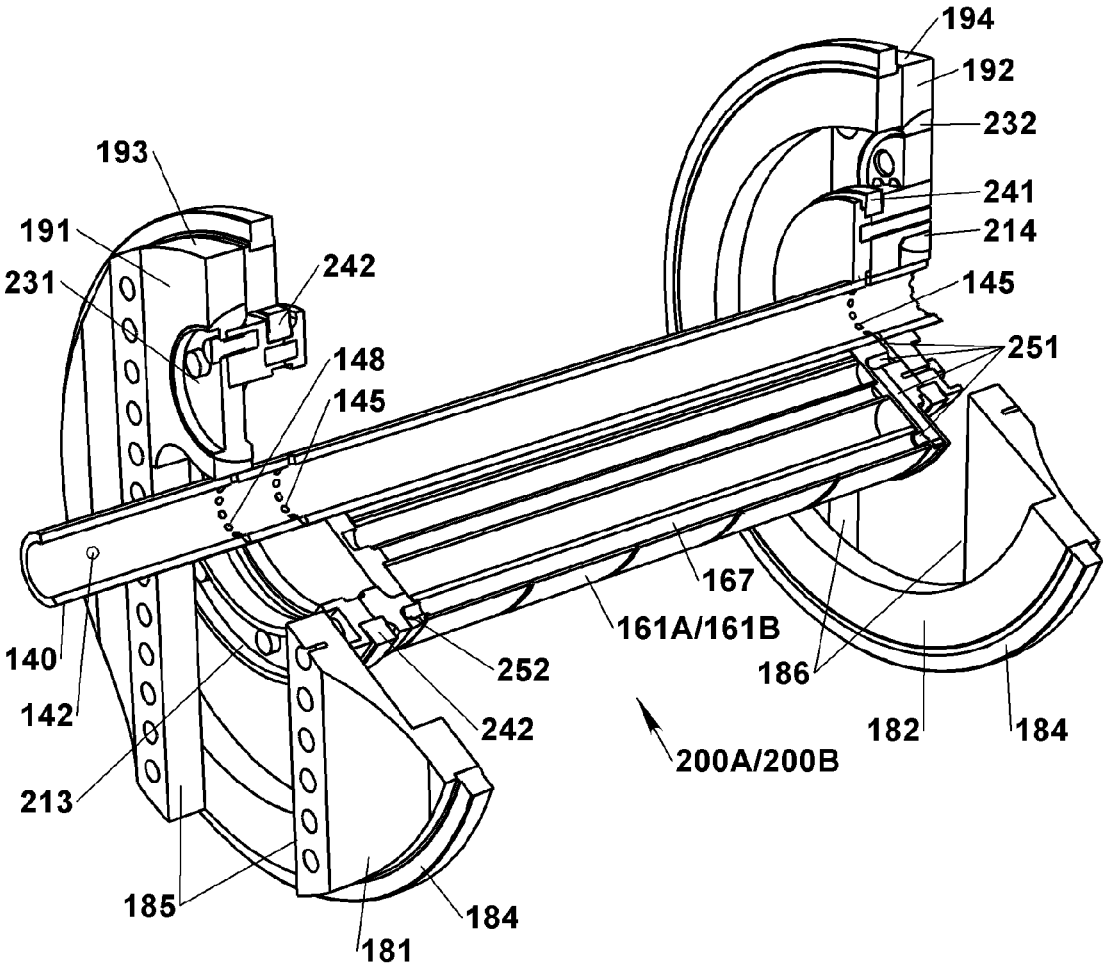
FIG. 6 is the first perspective view of the rotary assembly of FIG. 5 with drive pistons and fly wheels as in FIG. 3 in angled cut view.

Axial piston holes 1681 may serve as part of a lubricant supply channel to supply lubricant to the circumferential lubrication grooves 168. Each rotary piston 161A, 161B is preferably of an axially substantially continuous profile that may be fabricated by well known extrusion techniques. Axially substantially continuous means in the context of the present invention that axial discontinuities such as circumferential lubrication grooves 168, piston end seal lips 1693 and radial lubrication groove access holes 1681 are fabricated into the rotary pistons 161A/161B by material removal processes. The axial piston holes 1612, 167 are preferably through holes optionally also serving as part of a coolant transfer channel 251, 167, 252 as shown in FIG. 6.

Figure 8:
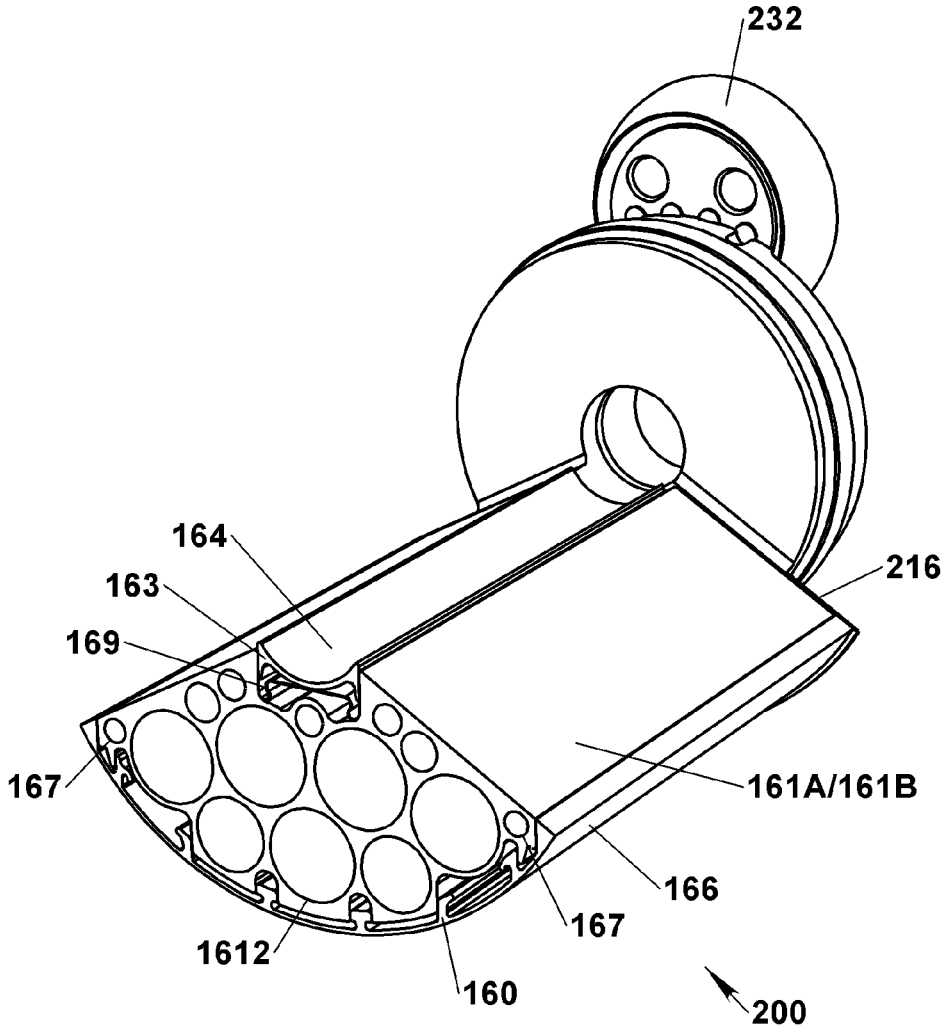
FIG. 8 is the second perspective view of the rotary assembly with a rotary piston of a second embodiment of the invention. The rotary assembly is cut along the vertical mid side plane.
Figure 9:
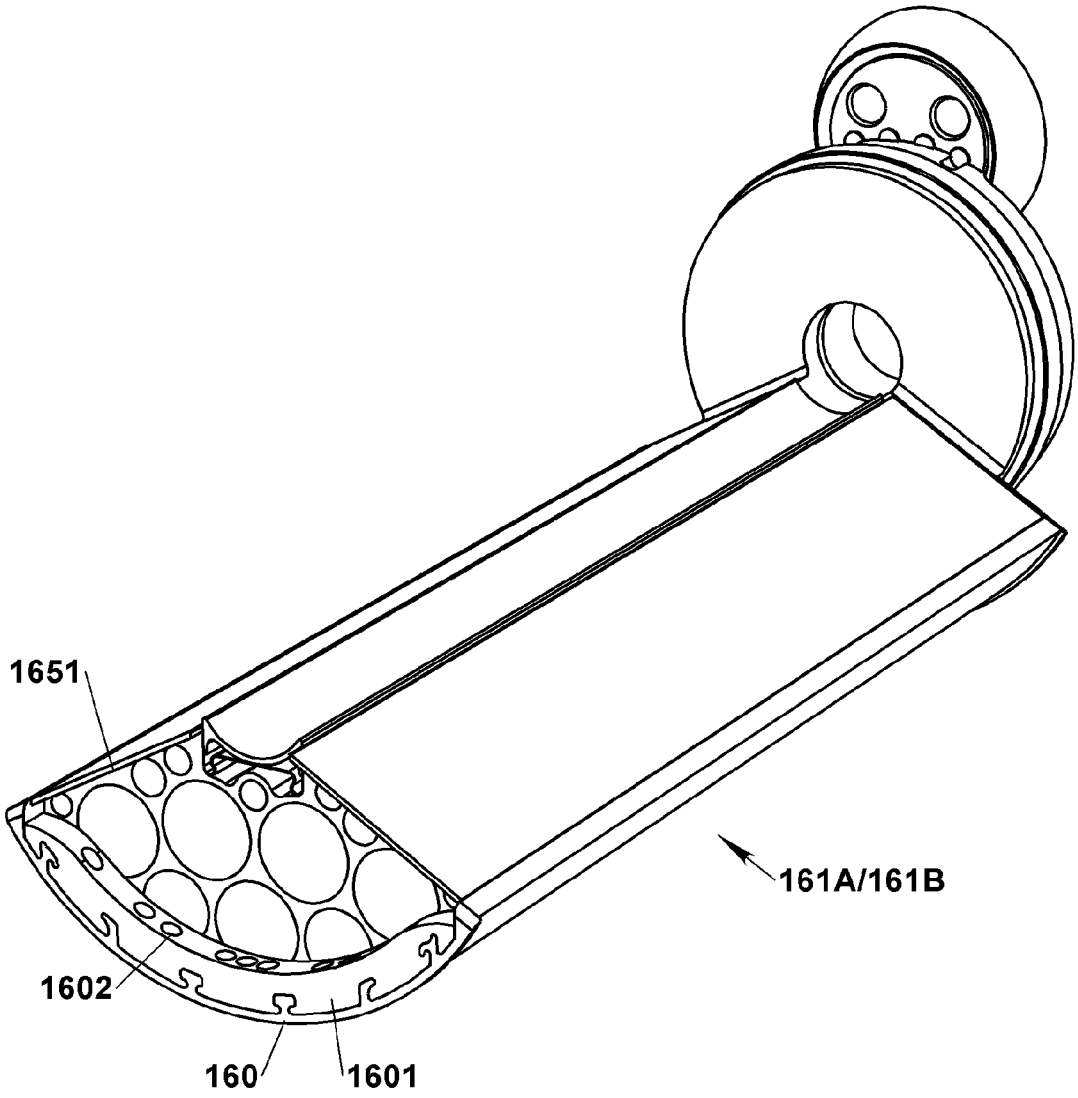
FIG. 9 is the second perspective view of the rotary assembly of FIG. 8 depicting the entire rotary piston.

In a second embodiment of the invention as depicted in FIGS. 8, 9, the rotary pistons 161A, 161B may each feature a peripheral seal profile 160 and center seal profile 163 that are both axially substantially flush with the respective rotary piston 161A/161B. Each peripheral seal profile 160 is radial outward sliding engaging with the respective rotary piston 161A/161B and features the peripheral contact face 166 configured for a snug sliding sealing contact with the primary peripheral wall 116. The center seal profile 163 may provide the center face 164 that is configured for a snug sliding sealing contact with the central seal wall 144. A radial spring profile 169 is springily interposed preferably between the respective rotary piston 161A/161B and the center seal profile 163 to resiliently press the center face 164 into contact with the central seal wall 144 in opposition to centrifugal forces. Nevertheless, the radial spring profile 169 and/or the like may be similarly springily interposed between the respective rotary piston 161A/161B and the peripheral seal profile 160. The peripheral seal profile 160 may be axially sliding interlocked at its axial ends with a stiffening rib 1601 that in turn may be radial coupled via radial pin holes 1602 with respective axial piston couplings 215, 216.

Center seal profile 163 and peripheral seal profile 160 provide area sealing irrespective eventual elastic radial deformation of the rotary piston 161A/161B due to centrifugal mass forces at high rotational speeds while the rotary pistons 161A/161B are radial fixed by the opposing axial piston coupling 215, 216 and while they are substantially free suspended in between them. The radial substantially free suspending of the rotary pistons 161A, 161B may contribute in transferring centrifugal mass forces of the rotary pistons 161A, 161B directly onto the respective crank disks 211, 212. Moreover and in the preferred case of the respective crank joints 231, 232 being diametrically opposite the axial piston couplings 215, 216 with respect to the primary rotation axis AP, a combined mass center MC of an individually driving rotary assemblies 200A/200B and its respective driving pistons 191, 192 may be predetermined to coincide with the primary rotation axis AP. In the second embodiment with the radial substantially free suspended rotary pistons 161A, 161B in conjunction with the combined mass center MC coinciding with the primary rotation axis AP, centrifugal mass forces of the rotary assembly 200 and the respective driving pistons 191, 192 may be substantially cancelled out within the rotary assembly 200. Only the centrifugal mass forces of the optional peripheral seal profile 160 and the optional stiffening rib 1601 may be transferred onto the housing 100. This may substantially reduce bearing loads on the disk interconnect bearings 241 and disk housing bearings 242 as well as vibration of the rotary piston device 100 at high rotational speeds. Disk housing bearings 242 are held in the housing 110 thereby defining the primary rotation axis AP for the rotary assemblies 200A, 200B, 200BA, 200BB of all three embodiments.

The two opposing flywheels 181, 182 are each positioned immediately outside and adjacent a respective bearing disk 213, 214. They are rotationally suspended via flywheel bearings 184 in the housing 110 thereby defining a secondary rotation axis AS for the flywheels 181, 182. The secondary rotation axis AS is stationary with respect to the housing 110 and in a primary offset OP to the primary rotation axis AP. Each of the two opposing flywheels 181/182 has a radial guide 185/186 in which two driving pistons 191/192 each belonging to a separate rotary assemblies 200A/200B are radial guided. The two opposing driving pistons 191,192 are joined with a respective crank joint 231,232 and rotationally suspended with respect to the tertiary rotation axis AT.

The flywheels 181, 182 rotate with a substantially constant secondary angular velocity together with the driving pistons 191, 192, which are radial held in constant distance to the primary rotation axis AP via the crank joints 231, 232. Hence, the driving pistons 191, 192 are once forced towards the secondary rotation axis AS and once forced back outwards during a single rotation of the flywheels 181, 182. As the driving pistons 191, 192 move radial back and forth, their primary angular velocities with respect to the primary rotation axis AP changes together with their respective joined rotary assembly 200A/200B. When the driving pistons 191, 192 are closest to the secondary rotation axis AS, the primary angular velocity of the rotary assembly 200 is at a minimum. When the driving pistons 191, 192 are at a maximum distance to the secondary rotation axis AS, their primary angular velocity of the rotary assembly is at a maximum. Between their maximum and minimum primary angular velocities, the rotary assemblies 200A, 200B are once accelerated and once decelerated in an alternating fashion during a single flywheel 181, 182 rotation. This in turn results in alternating circumferential expansion and contraction of work volumes 111A, 111B that are encapsulated inside the primary piston volume 114 in between the piston faces 165 and chamber seal faces 217, 218. Also, since one of the two rotary assemblies 200A, 200B together with its driving pistons 191, 192 is accelerated substantially at the same rate as the other one of the two rotary assemblies 200A, 200B with its driving pistons 191, 192 is decelerated, their respective angular mass forces substantially cancel each other out at radial guides 185, 186. This contributes to a steady rotational speed of the flywheels 181, 182 as may be well appreciated by anyone skilled in the art.

Figure 7:
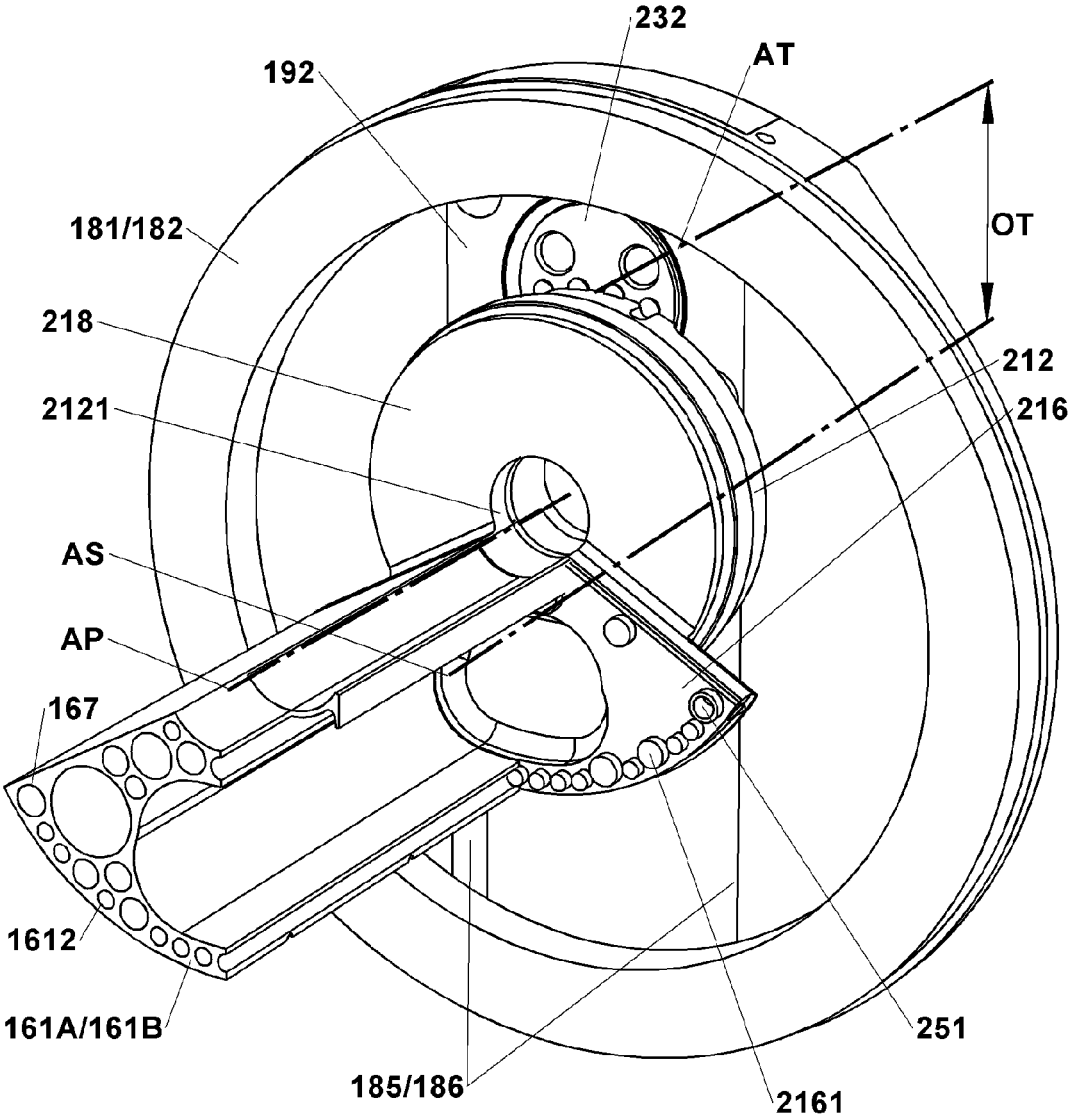
FIG. 7 is a second perspective view of the rotary assembly, one drive piston and one fly wheel as in FIG. 6. The rotary piston is cut along the vertical mid side plane and the vertical mid front plane.

The two opposing crank disks 213, 214 are preferably torque coupled across rotary pistons 161A, 161B and consequently the opposing flywheels 181, 182 are also rotationally coupled across the driving pistons 191, 192 and across the rotary assemblies 200A, 200B. As depicted in FIG. 7, torque coupling of the rotary pistons 161A, 161B with the axial piston couplings 215, 216 is accomplished by coupling protrusions 2161 that preferably axially loose interlock with through holes 1612, 167 of the rotary pistons 161A, 161B. The interlocking of the coupling protrusions 2161 with the through holes 1612, 167 may be rigid in radial direction in the second embodiment and may be radial rigid or loose in the first embodiment by predetermined radial interlock tolerances as may be well appreciated by anyone skilled in the art.

Each of the two assemblies 200A, 200B preferably features one primary bearing disk 211 and one secondary bearing disk 212 such that the two rotary assemblies 200A, 200B are intertwined around the primary rotation axis AP. In that case, a radial supply channel 251 may extend radial outward inside the secondary bearing disk 214 from a center tube hole 2121 up to an axial piston hole 167. A radial supply channel such as depicted supply channel 251 and an axial piston hole such as piston hole 167 may be part of a lubricant supply channel that supplies lubricant to the lubrication grooves 168 on the peripheral piston face 166. Radial lubrication groove access holes 1681 may be connecting for that purpose the outside lubrication grooves 168 with the inside of a corresponding axial piston hole. The axial piston hole 167 may be a through hole and connected with a radial drain channel 252 extending outward from the axial piston hole 167 in the primary bearing disk 213. Radial supply channel 251, axial through hole 167 and radial drain channel 252 may be part of a coolant transfer channel through which coolant may be transferred through the rotary pistons 161A, 161B. The axial coolant through holes 167 preferably in proximity to the peripheral edges of the piston faces 165 where maximum heat transfer with the work fluid during its intake and/or exhaust may occur. Coolant and/or lubricant exiting the rotary assemblies 200A, 200B may be captured by drain grooves in the peripheral wall 116 as may be well appreciated by anyone skilled in the art.

A piston slider 170 axially extending along the primary rotation axis AP and substantially flush with the rotary pistons 161A, 161B may be circumferential positioned at the primary piston chamber 114, where the rotary pistons 161A, 161B pass by in closest proximity and where the work volumes 111A/111B are at a minimum. The piston slider 170 may skim the peripheral piston faces 166 from lubricant and/or coolant while at the same time providing a sealing barrier between oppositely adjacent high pressure fluid access 120 and low pressure fluid access 130.

Also held in the housing 110 is a center tube 140 that is concentric with respect to and axially extending along the primary rotation axis AP. The center tube 140 is inserted from at one side of the housing 110 and extends through the opposing flywheels 181, 182, through center tube holes 2121 in the secondary bearing disks all the way across the rotary assemblies 200A, 200B. The center tube 140 has an axial service fluid channel 142 in communication with circumferential assembly supply holes 145, which in turn are axially aligned and in rotationally free communication with the service fluid channel 251, 167, 252 and the like lubrication channel. Likewise, the center tube 140 may feature driving piston supply holes 148, that supply the interfaces between driving pistons 191, 192 and radial guides 185, 186 as well as crank joints 231, 231 with lubricant and/or coolant. Since the flywheels 181, 182 are torque coupled via driving pistons 191, 192 and rotary assemblies 200A, 200B, the center tube 140 may be conveniently utilized for coolant and lubricant supply at the location otherwise occupied by central torque transmitting shafts well known in the prior art.

Referring to FIGS. 10-18 and in accordance with a third embodiment of the invention, secondary rotary assemblies 200BA, 200BB may be axially connected with each of the rotary assemblies 200A, 200B at one of the crank joints 231, 232 combined in a central crank joint 233. A central driving piston 195 may be joined to the central crank joint 233. The connection is preferably such that a primary bearing disk 211 is facing a secondary bearing disk 212 at the central crank joints 233. The crank joints 231, 232, 233 may be preferably configured with spherical bearing surfaces such that elastic angular deformation in the crank joints 231, 232, 233 due to torque transfer, angular mass force cancellation, and local centrifugal mass forces is not transferred onto the drive pistons 191, 192, 195. Thereby peak contact pressures in the bearing interfaces between driving pistons 191, 192, 195 and crank joints 231, 232, 233 as well as between driving pistons 191, 192, 195 and radial guides 185, 186 may be substantially avoided. The central driving pistons 195 may be axially segmented such that the central crank joint 233 may be sandwiched in between the axial segments of the central driving piston 195.

Figure 11:
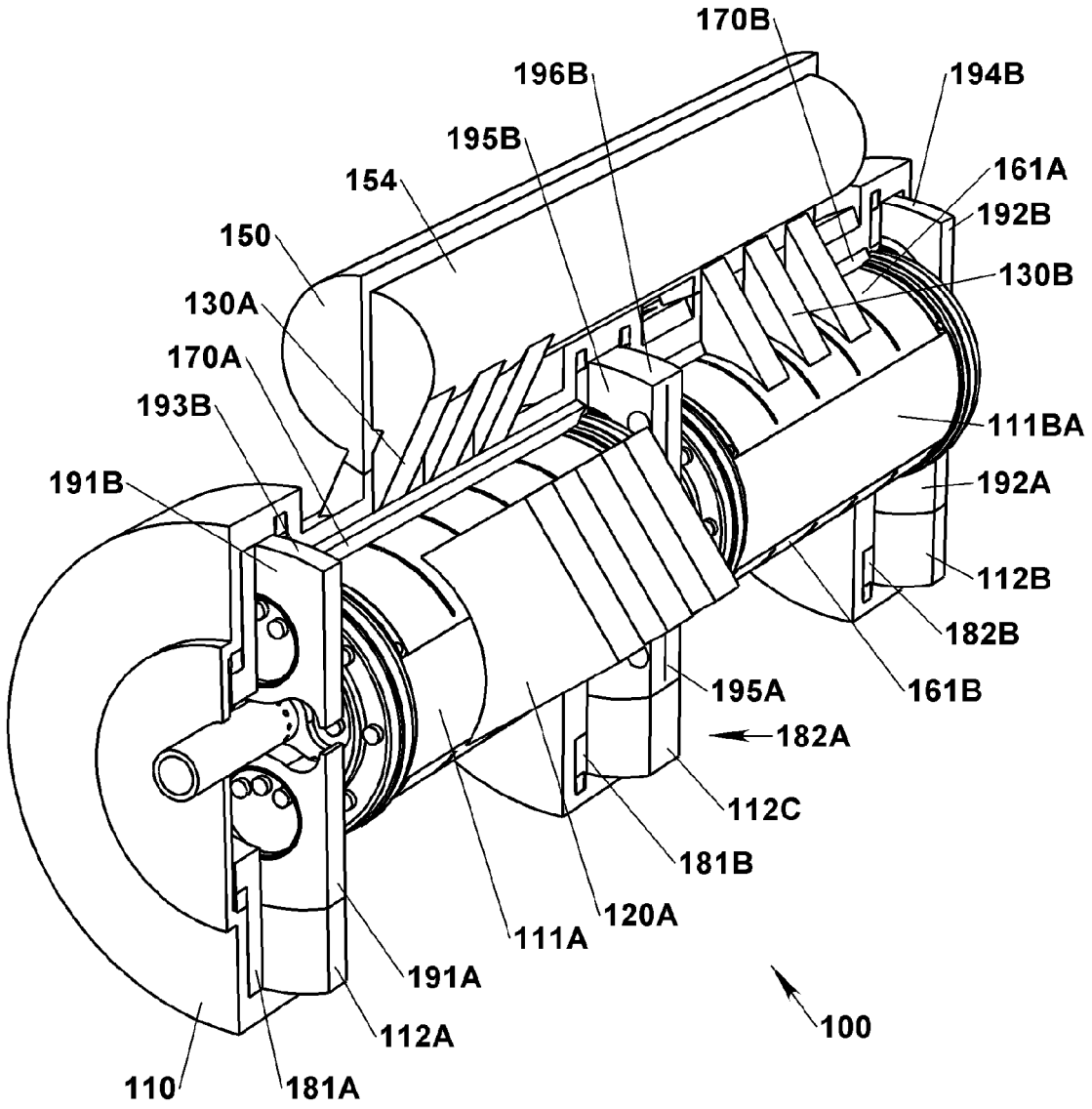
FIG. 11 is the second perspective view of the third embodiment rotary piston device with the housing and flywheels cut along the vertical mid front plane. Depicted as solids are also work volumes and fluid accesses and a combustion volume as provided in the third embodiment.
Figure 12:
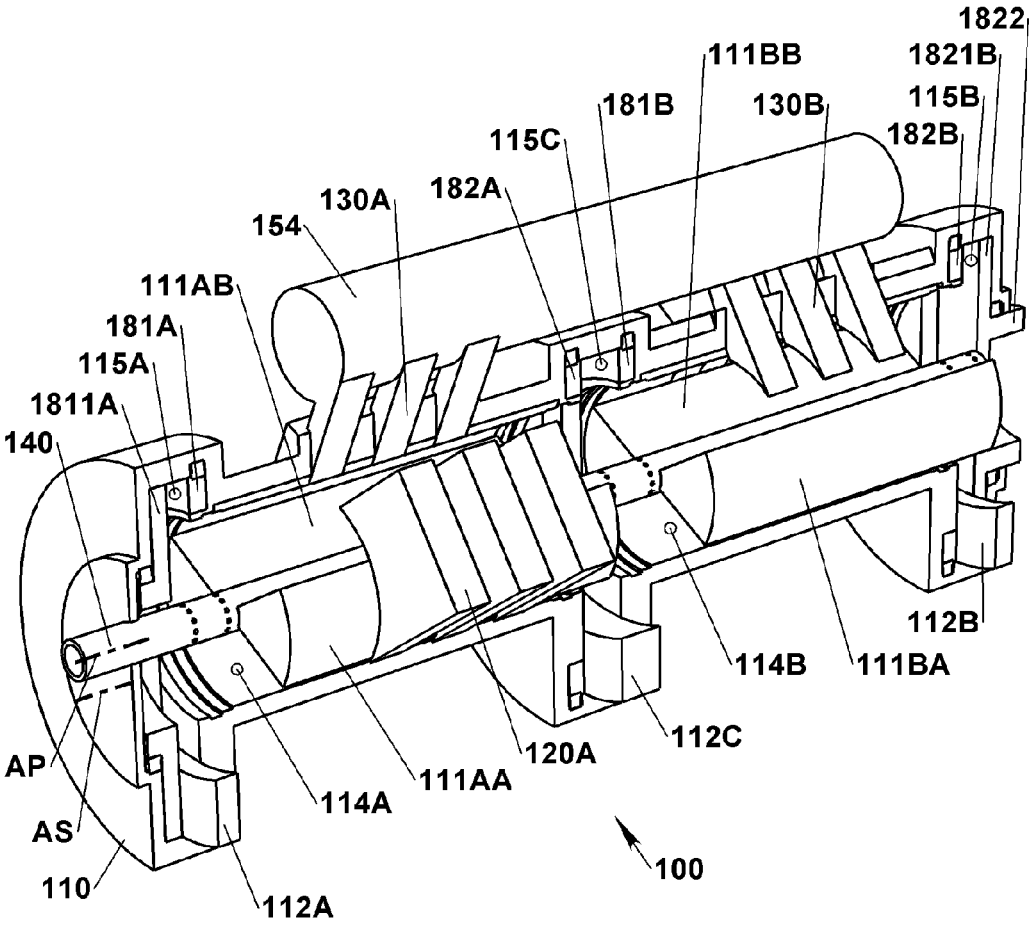
FIG. 12 is the first perspective view of the third embodiment as in FIG. 11 without doubled rotary assemblies and without driving pistons.

FIGS. 11, 12 depict the rotary piston device 100 of the third embodiment including the housing 110. Primary piston volumes 111A, 111BA as well as low pressure accesses 120A, 120B, high pressure accesses 130A, 130B and fluid transfer volume 154 in the preferred configuration as a combustion volume are depicted as solids. The driving pistons 191, 192 may contribute with their radial piston faces 193A, 193B, 194A, 194B in encapsulating secondary work volumes 112A, 112B, 112C in between the radial guides 185, 186, the respective flywheels 181, 182 and within secondary piston chambers 115A, 115B, 115C. The secondary piston chambers 115A, 115B, 115C are concentric with respect to secondary rotation axis AS. The flywheels 181, 182 rotate within the secondary piston chambers 115A, 115B, 115C. The bearing disks 213, 214 axially separate the primary piston chamber(s) 114A, 114B from the secondary piston chambers 115A, 115B, 115C. Central piston faces 196 of the central drive pistons 195 may contribute to encapsulate central secondary work volumes 112C as described for secondary work volumes 112A, 112B. The central work volumes 112C may be preferably utilized to receive combusting fluid.

Figure 19A:
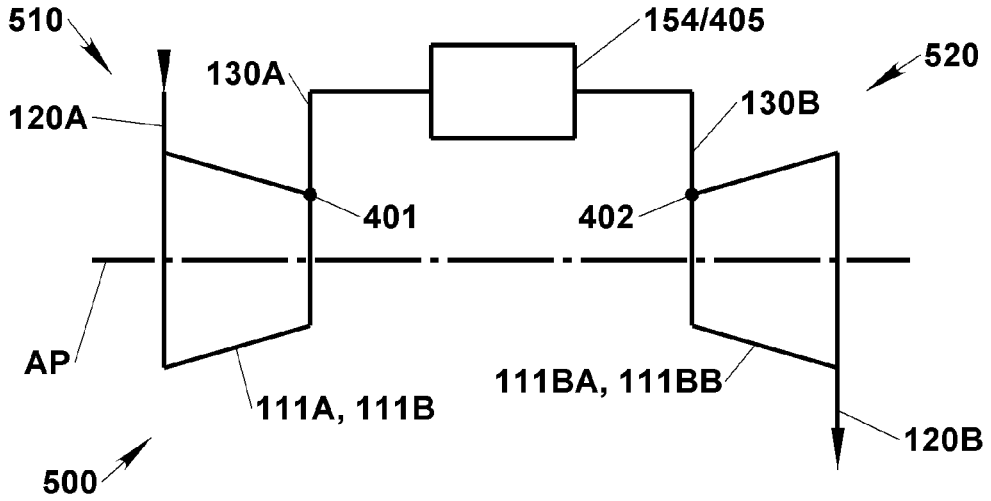
FIG. 19A depicts an operation schematic of a single stage engine configuration of the rotary piston device.
Figure 19B:
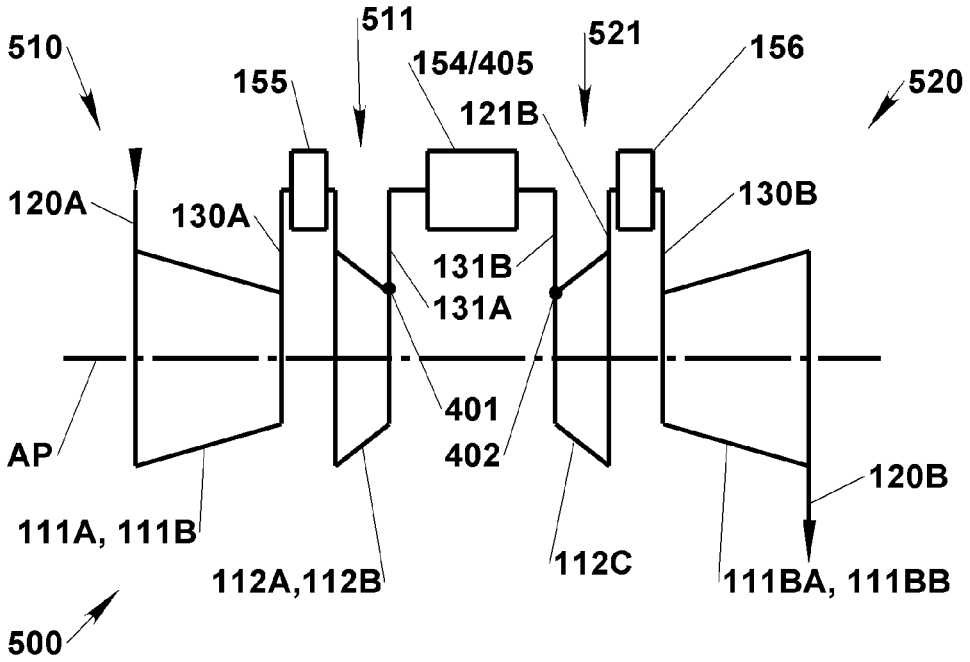
FIG. 19B depicts an operation schematic of a dual stage engine configuration of the rotary piston device.

The rotary piston device 100 may be utilized to compress fluid or to derive mechanical energy from compressed fluid as a motor. In the third embodiment, a compression stage may be conveniently combined with motor stage and the whole rotary device 100 may operate as a combustion engine in which compressed air and/or air/fuel mixture is thermally energized in a well known fashion after exiting primary work volumes 111A, 111B in a pressurized condition and before or while entering secondary work volumes 111BA, 111BB through secondary pressure fluid access 130B. For that purpose, the fluid transfer housing 150 may be configured as a well known combustion chamber. The third embodiment rotary piston device 100 may be operated as single stage combustion engine as schematically depicted in FIG. 19A or as a dual stage combustion engine as schematically depicted in FIG. 19B. In the single stage operation, work fluid such as air and/or air/fuel mixture is compressed in a single stage prior to combustion and expanded in a singe stage following and/or during combustion of the air/fuel mixture. In the dual stage operation, fluid compression may be performed initially in the circumferential changing work volumes 111A, 111B that are a multiple of the radial changing work volumes 112A, 112B while both are maximum expanded. In a fluid cooler 155 placed along a fluid transfer channel between initial compression stage and final compression stage, the initially compressed fluid may be cooled down before entering the secondary piston chamber(s) 115A and/or 115B and before being compressed a second time. Fluid expansion may also be separated in two stages with the initial high pressure expansion preferably taking place in the central secondary piston chamber 115C, where double bearing disk support of each central crank joint 233 may handle higher fluid pressures. Breaking up the expansion of the combusting air/fuel mixture into two stages provides for additional combustion reaction time before entering the final expansion stage again in a primary combustion chamber 114B. For that purpose, a reactor 156 may be placed along a fluid transfer channel between high pressure and low pressure expansion stages.

The scope of the invention is not limited to a particular dimensional relation of primary offset OP and secondary OS. Nevertheless and as depicted, the primary offset OP may be about half the secondary offset OS and the angular extension of the rotary pistons 161A, 161B around the primary rotation axis AP may be about 120 degrees. In that case, the rotary pistons 161A, 161B are in closest proximity to each other and the work volumes 111A, 111B, 111BA, 111BB may be about zero in an angular position of the radial guides 185, 186 as depicted for work volumes 111B, 111BB in FIG. 13. A dead volume well known in the prior art may be thereby substantially avoided. At that angular flywheel 181, 182 orientation, the radial guides 185, 186 are about perpendicular to an axis plane PL that coincides with primary rotation axis AP and secondary rotation axis AS. Also at that angular orientation, both intertwined rotary assemblies 200A, 200BA and 200B, 200BB have maximum angular acceleration and deceleration respectively and the same angular velocity as the flywheels 181, 182. The piston sliders 170 are positioned also such that they contact the piston faces 166 while coinciding with the axis plane PL.

Figure 13:
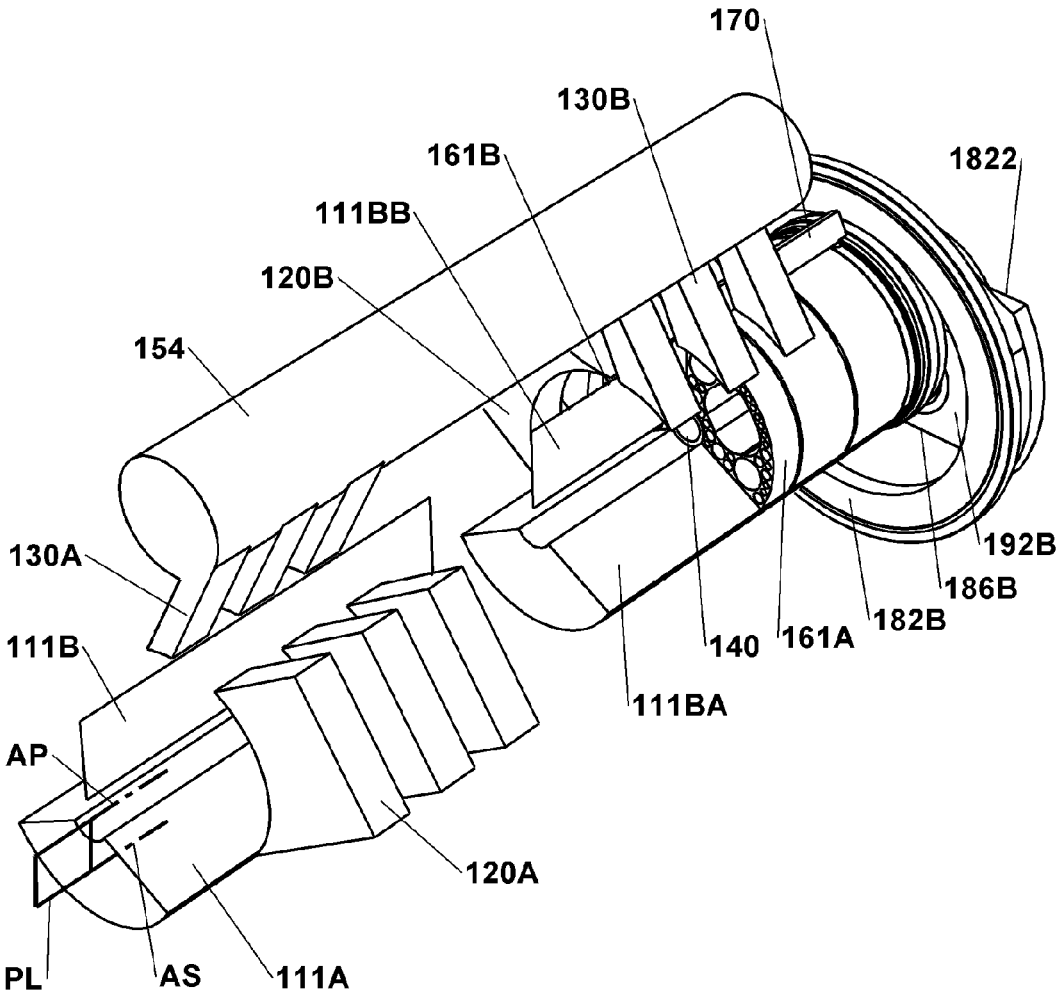
FIG. 13 is a third perspective view of the work fluid volumes and channels at a first angular flywheel position. The doubled rotary assemblies are cut along a rear vertical mid side plane.
Figure 14:
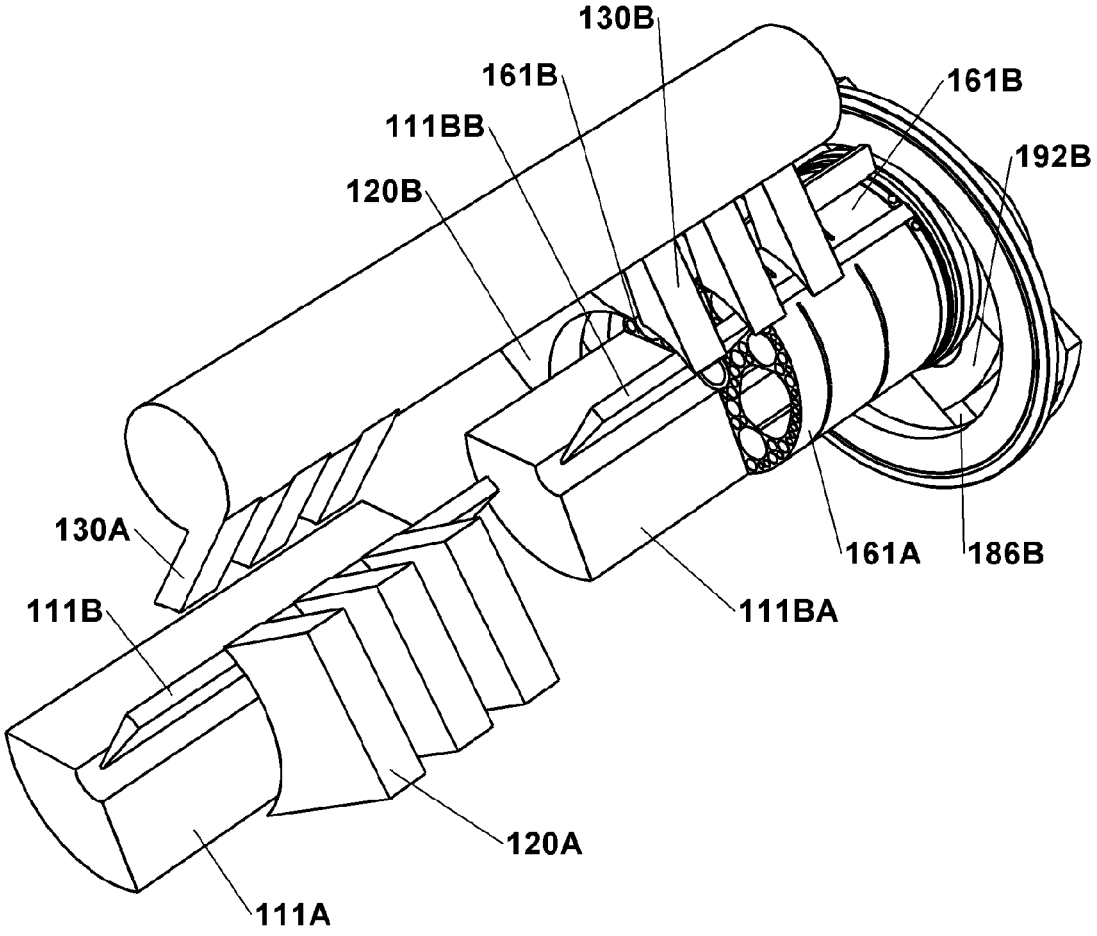
FIG. 14 is the third perspective view as in FIG. 13 at a second angular flywheel position in a 30 deg clockwise progression to the first angular flywheel position.
Figure 15:
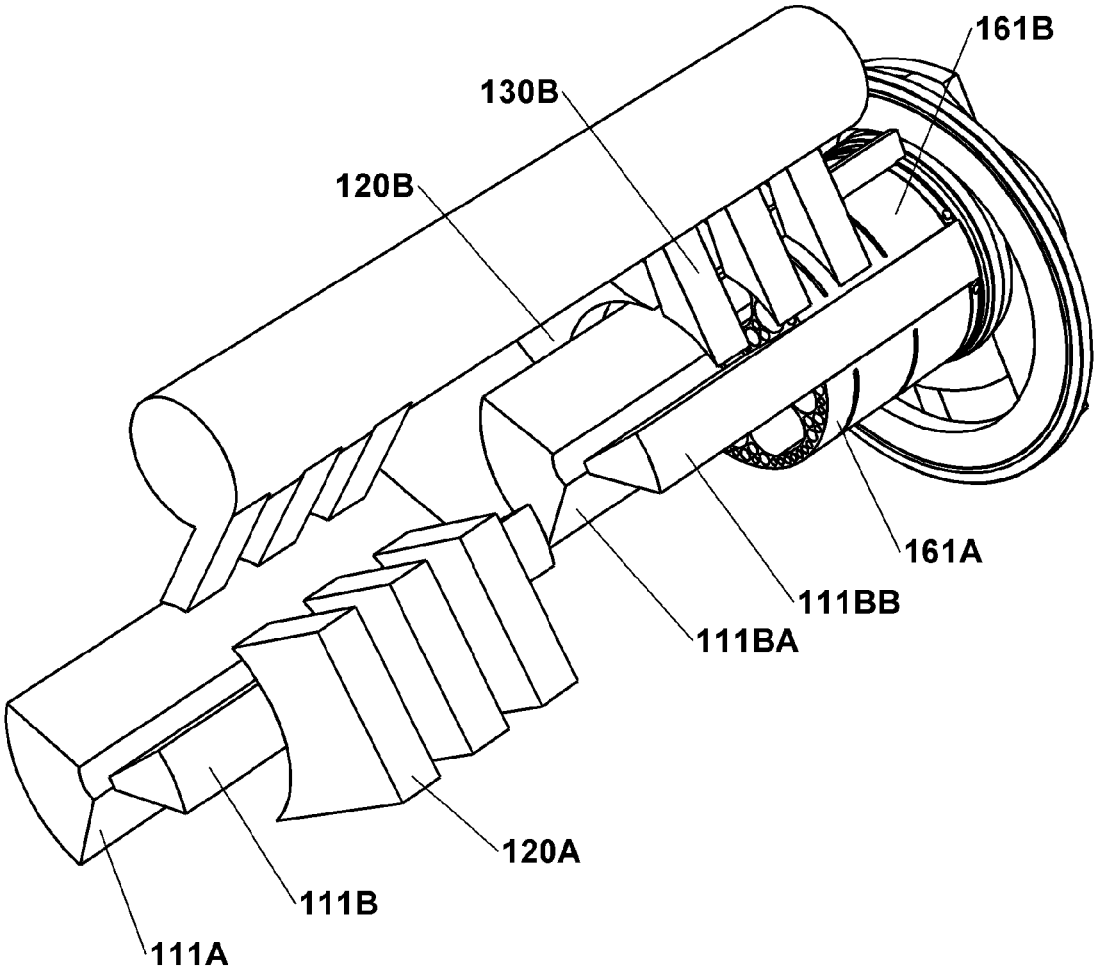
FIG. 15 is the third perspective view as in FIG. 13 at a third angular flywheel position in a 30 deg clockwise progression to the second angular flywheel position.
Figure 16:
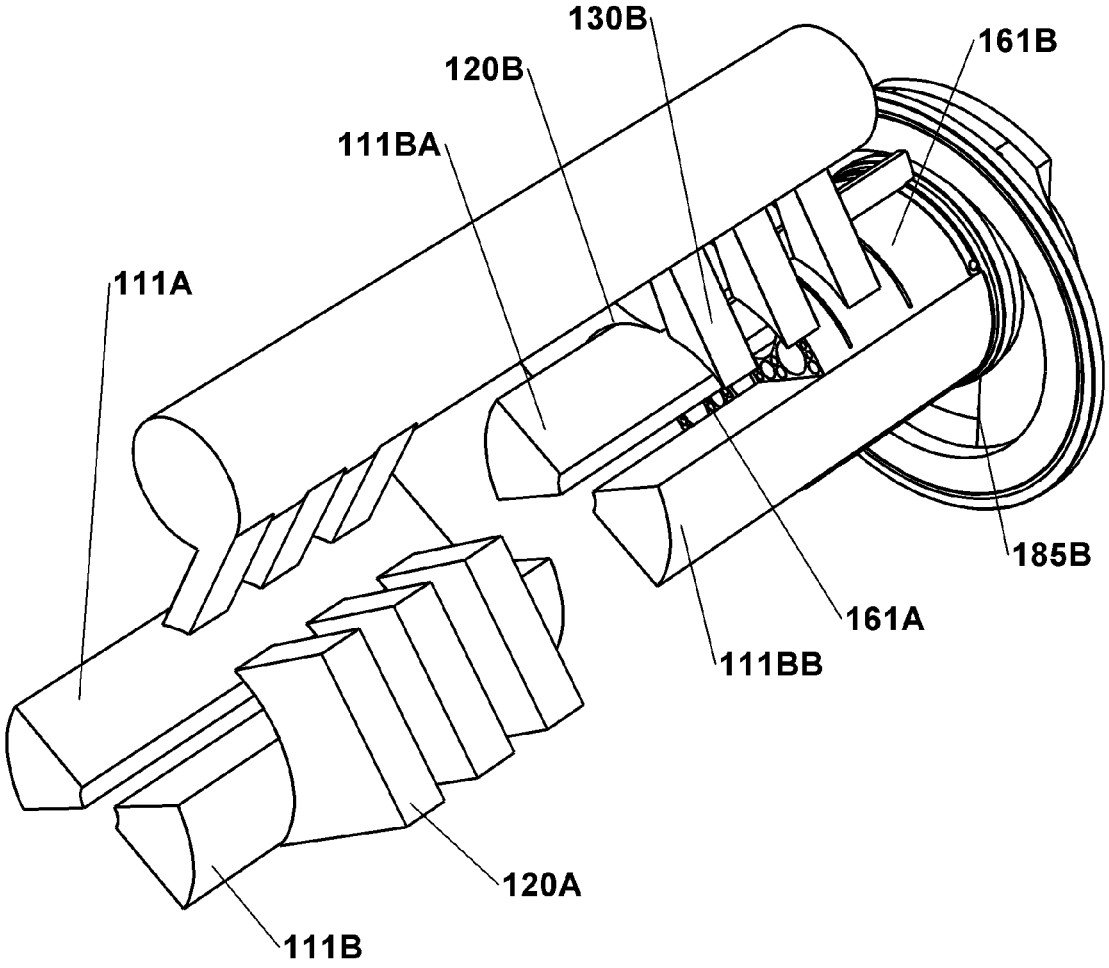
FIG. 16 is the third perspective view as in FIG. 13 at a fourth angular flywheel position in a 30 deg clockwise progression to the third angular flywheel position.
Figure 17:
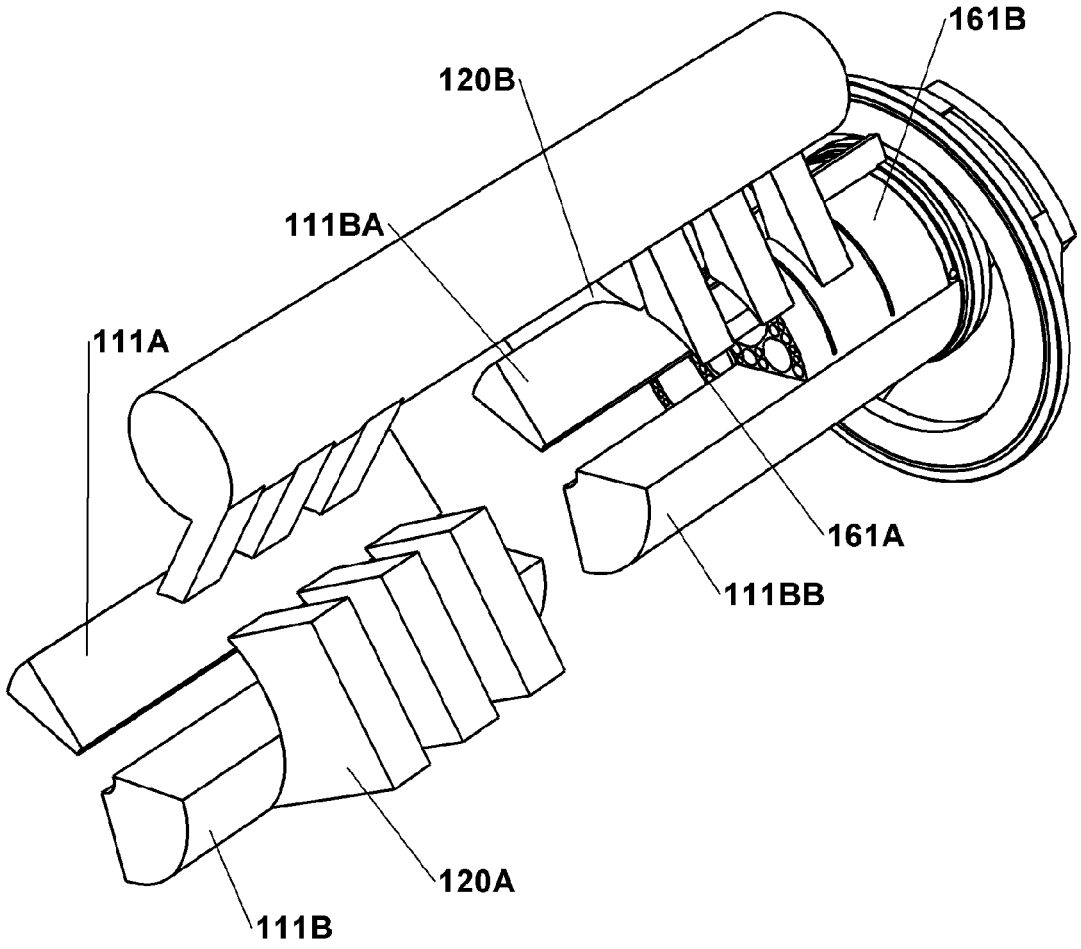
FIG. 17 is the third perspective view as in FIG. 13 at a fifth angular flywheel position in a 30 deg clockwise progression to the fourth angular flywheel position.
Figure 18:
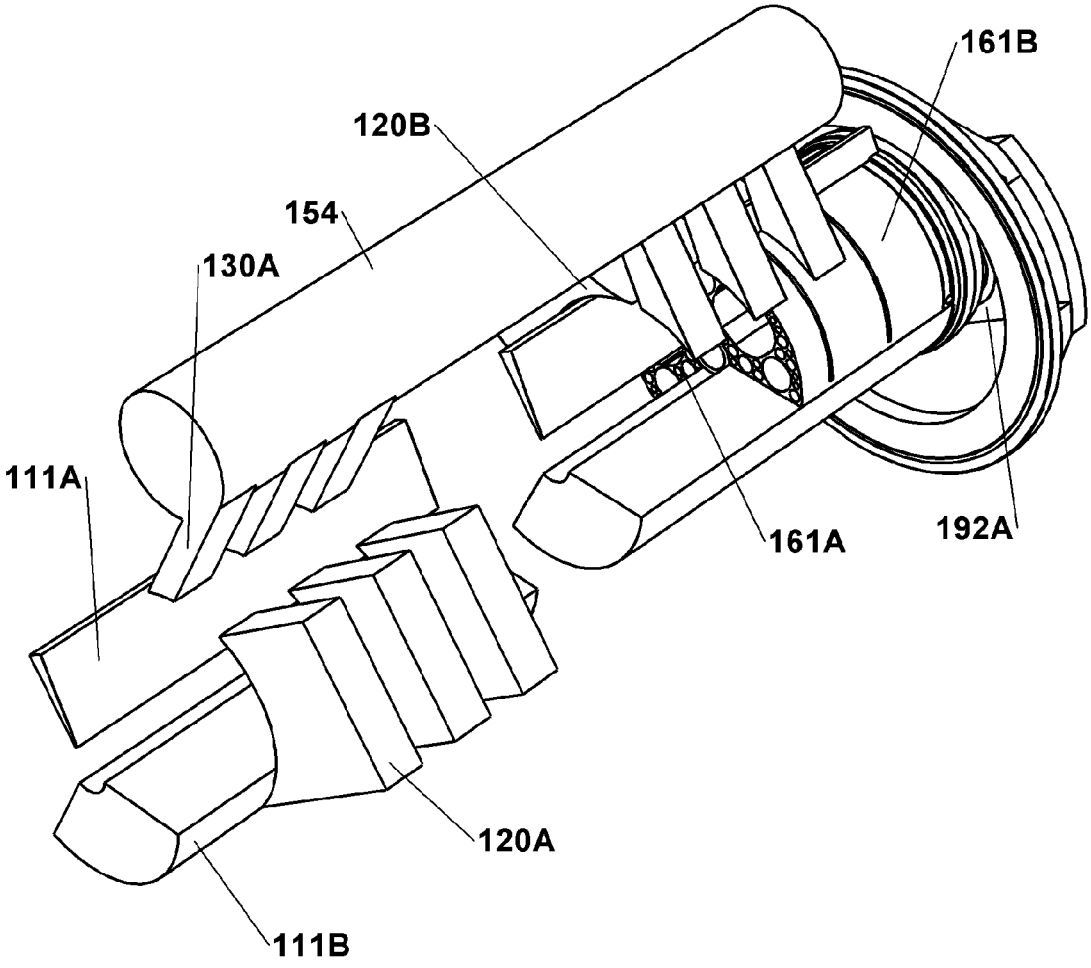
FIG. 18 is the third perspective view as in FIG. 13 at a sixth angular flywheel position in a 30 clockwise progression to the fifth angular flywheel position.

As the flywheels 181, 182 continue to rotate, the depicted driving piston 192B moves closer to the secondary rotation axis AS thereby reducing its primary angular velocity together with the rotary piston 161B and its equivalent rotary assembly while the other intertwined rotary assembly with its depicted rotary piston 161A is accelerated at the same rate. Consequently, work volumes 111B, 111BB expand, while work volumes 111A, 111BA contract. This is depicted in the FIGS. 14-18 with 30 deg rotationally increments of the flywheels 181, 182. In FIG. 13, the work volume 111B just got out of access with high pressure access 130A after its contained pressurized air and/or air/fuel mixture was transferred to the combustion volume 154. Pressure rise due to combustion in the closed combustion volume 154 may occur. In FIG. 14, work volume 111BB receives combusting air/fuel mixture via high pressure accesses 103B while work volume 111B opens up to low pressure access 120A and receives low pressure ambient air and/or fuel air mixture. Work volume 111A is contracting and pressurizing the contained air and/or air/fuel mixture. Work volume 111BA is accessed by low pressure access 120B and releasing the contained expanded combusted air/fuel mixture. In FIGS. 15-18, work volume 111BB is out of access with high pressure access 130B while work volume 111B is still accessed by low pressure access 120A and work volume 111BA is still accessed by low pressure access 120B. In FIG. 18, the work volume 111A is about to release the contained air and/or air/fuel mixture into the high pressure access 130A and the combustion chamber 154.

Figure 10:
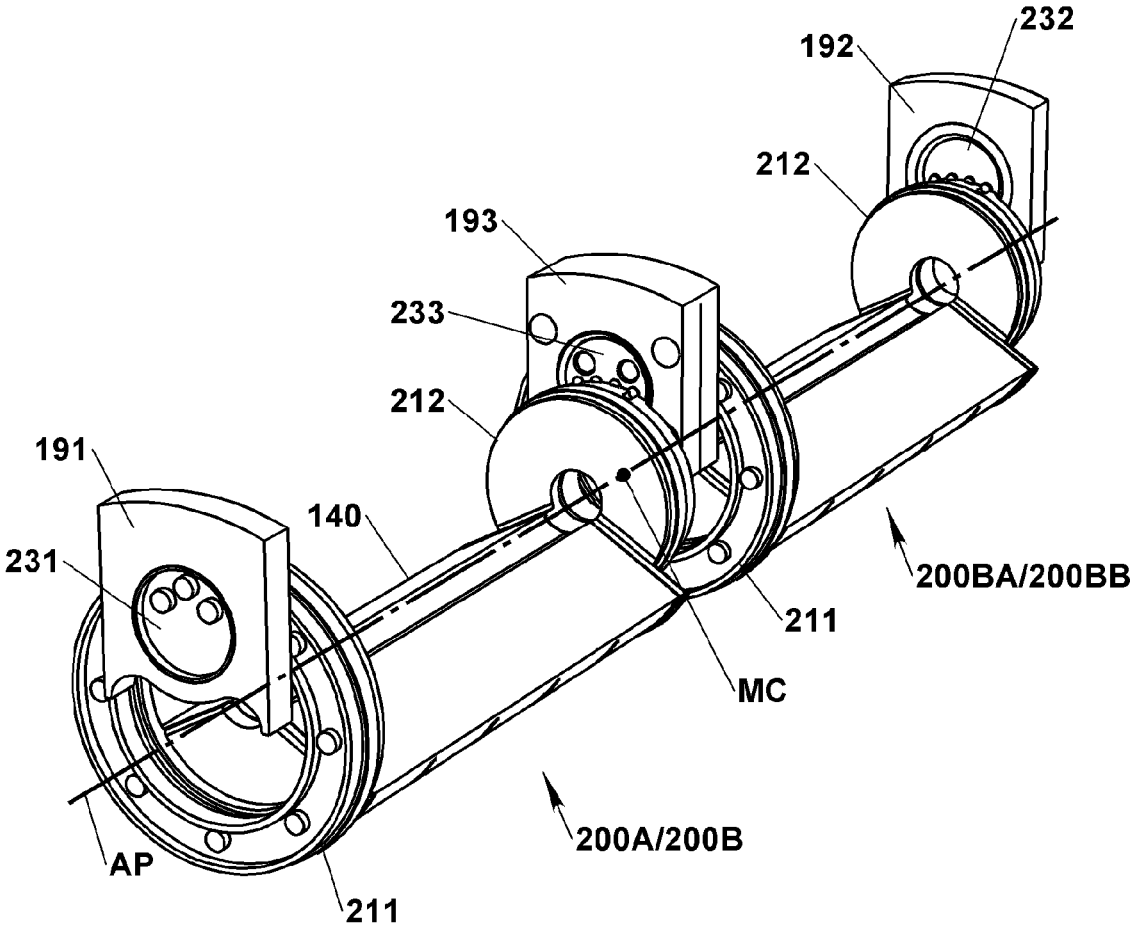
FIG. 10 is the second perspective view of a doubled rotary assembly of a third embodiment of the invention.

In a best mode anticipated by the inventor at the time of filing this invention, a single stage rotary piston device 100 similar as depicted in the FIGS. 10-12 may be designed with rotary pistons 161A, 161B being about 200 mm long with peripheral wall 116 diameter of about 100 mm and center tube 140 diameter of about 20 mm. The work volumes 111A, 111B at their maximum circumferential expansion measure about 0.5 liter such that during one full rotation of the flywheels 181, 182 about 1 liter of fluid transfer volume is provided. Crank joints 231, 232, 233 and crank joint adjacent portions of the bearing disks 231, 232 as well as bolts and sheer pins inside the flywheels 181, 182 and bearing disks 231 232 may be of alloy steel. The remaining parts may be of high strength aluminum alloy. The primary offset OP is about 17.5 mm and the secondary offset OS about 35 mm. Full complement ball bearings are used for bearings 241, 242, 184.

The mass of each doubled rotary assembly 200A+200BA, 200B+200BB including its respective driving pistons 191, 192, 195 is about 2.3 kg with their respective combined mass centers MC substantially coinciding with the primary rotation axis AP.

< >

As described above, radial guides 185/186 in contact with drive pistons 191/192 in contact with crank joints 231/232 combined with crank disks 211/212 combined with axial piston couplings 215/216 define primary and secondary kinetic linkages 185-191-231-211-215/186-192-232-212-216 that are orbitally varyingly and individually kinetically linking each of the rotary pistons 161A, 161B with opposing and synchronously rotating flywheels 181,182 via respective ones of the two opposing axial primary piston ends 1691, 1692. In that way, the rotary pistons 161A, 161B are individually angularly accelerated and alternately angularly decelerated via the two opposing axial piston ends 1691, 1692. At the same time, the rotary pistons 161A, 161B are moved via the kinetic linkages 185-191-231-211-215, 186-192-232-212-216 along a continuous path around the primary rotation axis AP. In conjunction with the kinetic linkages 185-191-231-211-215, 186-192-232-212-216 the rotary piston device 100 may be configured as a system with additional functionality like, varying compression ratio, burst mode engine operation, brake energy recycling, and as a combustion engine system with solid particle fuel capacity with optional carbon particle extraction.

Figure 26A:
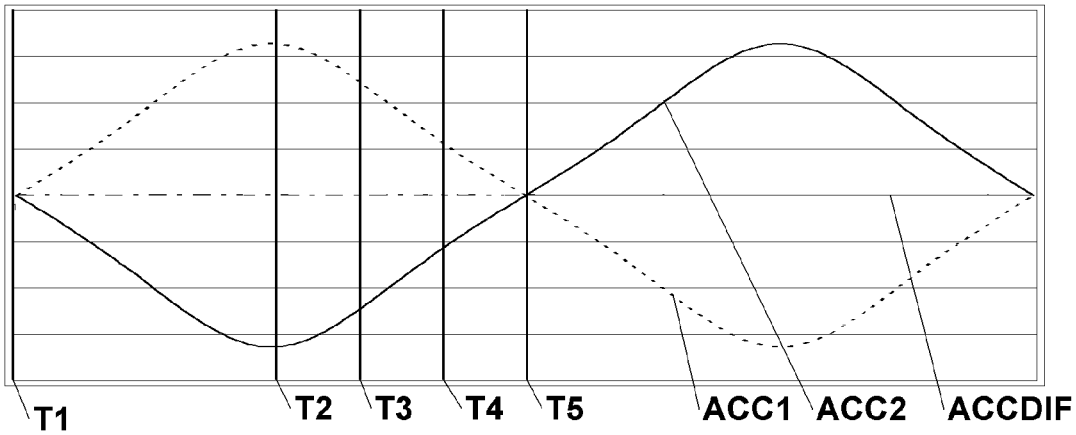
FIG. 26A is a graph of rotation angle depending angular accelerations and their difference of two individual rotary assemblies within a piston chamber along a single rotation.
Figure 26B:
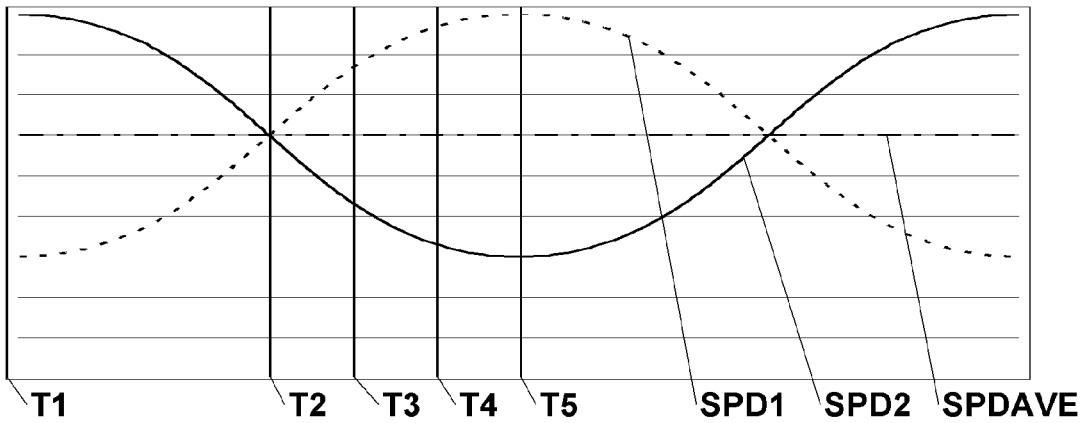
FIG. 26B is a graph of rotation angle depending angular velocities and their average of the two rotary assemblies of FIG. 26A.
Figure 26C:
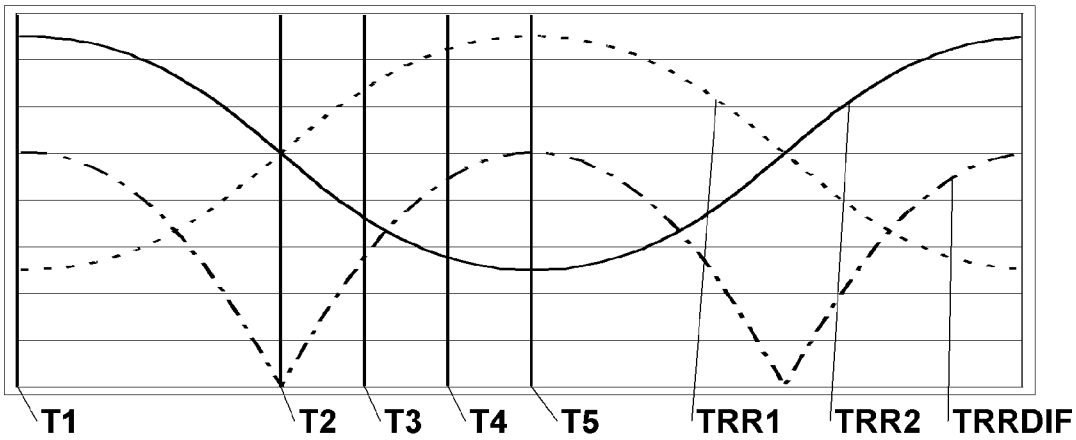
FIG. 26C is a graph of rotation angle depending transmission ratios and their difference of kinetic linkages between the two rotary assemblies of FIGS. 26A, 26B and their flywheels.

As shown in FIG. 26C, the kinetic linkages 185-191-231-211-215, 186-192-232-212-216 provide rotation angle depending transmission ratios TTR1, TTR2 that alternately increase and decrease during a single rotation of the flywheel 181, 182. The transmission ratios TTR1, TTR2 change, because only the secondary offset OS remains constant while the tertiary offset OT between primary rotation axis AP and tertiary rotation axis AT changes as the drive pistons 191, 912 move in their respective radial guides 185, 186 while the flywheels 181, 182 rotate. The transmission ratios TTR1, TTR2 relate to the proportion between tertiary offset OT and secondary offset OS as may be clear to anyone skilled in the art. The solid curve corresponds to a first transmission ratio TTR1 synchronously induced via one primary kinetic linkage 185-191-231-211-215 and one axially opposite secondary kinetic linkage 186-192-232-212-216 onto both axial opposing piston ends 1691, 1692 of the rotary piston 161A in FIGS. 11, 13-18. The dashed curve corresponds to a second transmission ratio TTR2 synchronously induced via one other primary kinetic linkage 185-191-231-211-215 and one other axially opposite secondary kinetic linkage 186-192-232-212-216 onto both axial opposing piston ends 1691, 1692 of the rotary piston 161B in FIGS. 11, 13-18. The dot-dashed curve illustrates the transmission ratio difference TRRDIF between first and second transmission ratios TRR1, TRR2 that occurs while the opposite flywheels 181, 182 make a single full rotation. The transmission ratio difference TRRDIF corresponds to an rotation angle depending net torque acting on the opposite flywheels 181, 182 resulting from fluid pressure forces equally and oppositely acting on opposite piston faces 165 of the rotary pistons 161A, 161B that are encapsulating each of the circumferential changing work volumes 111A, 111B, 111BA, 111BB. In case the rotary piston device 100 acts as a compressor or pump, the net torque tends to decelerate the flywheels 181, 182. In case the rotary piston device 100 acts as a motor, the net torque tends to accelerate the flywheels 181, 182.

As shown in FIG. 26B, the angle depending transmission ratios TTR1, TTR2 result in angle depending speeds SPD1, SPD2 of the rotary assemblies 200A, 200B around the primary rotation axis AP. The solid curve depicts angular speed SPD1 corresponding to first transmission ratio TRR1. The dashed curve depicts angular speed SPD2 corresponding to second transmission ratio TRR2. The dot-dashed curved corresponds to the average speed SPDAVE, which is also the speed of the flywheels 181, 182. In case where primary offset OP is half the secondary offset OS, the angle depending speeds SPD1, SPD2 vary up to 50% off the average speed SPDAVE.

As shown in FIG. 26A, the angle depending transmission ratios TTR1, TTR2 result also in angle depending accelerations ACC1, ACC2 of the rotary assemblies 200A, 200B around the primary rotation axis AP. The solid curve depicts angular acceleration ACC1 corresponding to first transmission ratio TRR1. The dashed curve depicts angular acceleration ACC2 corresponding to second transmission ratio TRR2. The dot-dashed curved corresponds to the acceleration difference ACCDIF, which is substantially zero during continuous flywheel 181, 182 rotation. Angular acceleration and deceleration mass forces of the two rotary assemblies 200A, 200B hence cancel each other substantially out in the preferred case of both rotary assemblies 200A, 200B having equal inertias. In FIGS. 26A, 26B, 26C the timelines T1 correspond to the rotational snapshot depicted in FIG. 11 and the timelines T2-T5 to rotational snapshots respectively depicted in FIGS. 13-18. Irrespective the preferred case of two employed rotary assemblies 200A, 200B, the scope of the present invention is not limited to two rotary assemblies 200A, 200B only. For example, a larger number of rotary assemblies may be conveniently integrated in case the kinetic linkages 185-191-231-211-215/186-192-232-212-216 are configured without crank disks 211, 212, the radial guides 185/186 are facing the primary piston chamber 114 and the drive pistons 191/192 are directly rotationally joined with the axial piston couplings 215, 216.

Figure 20:
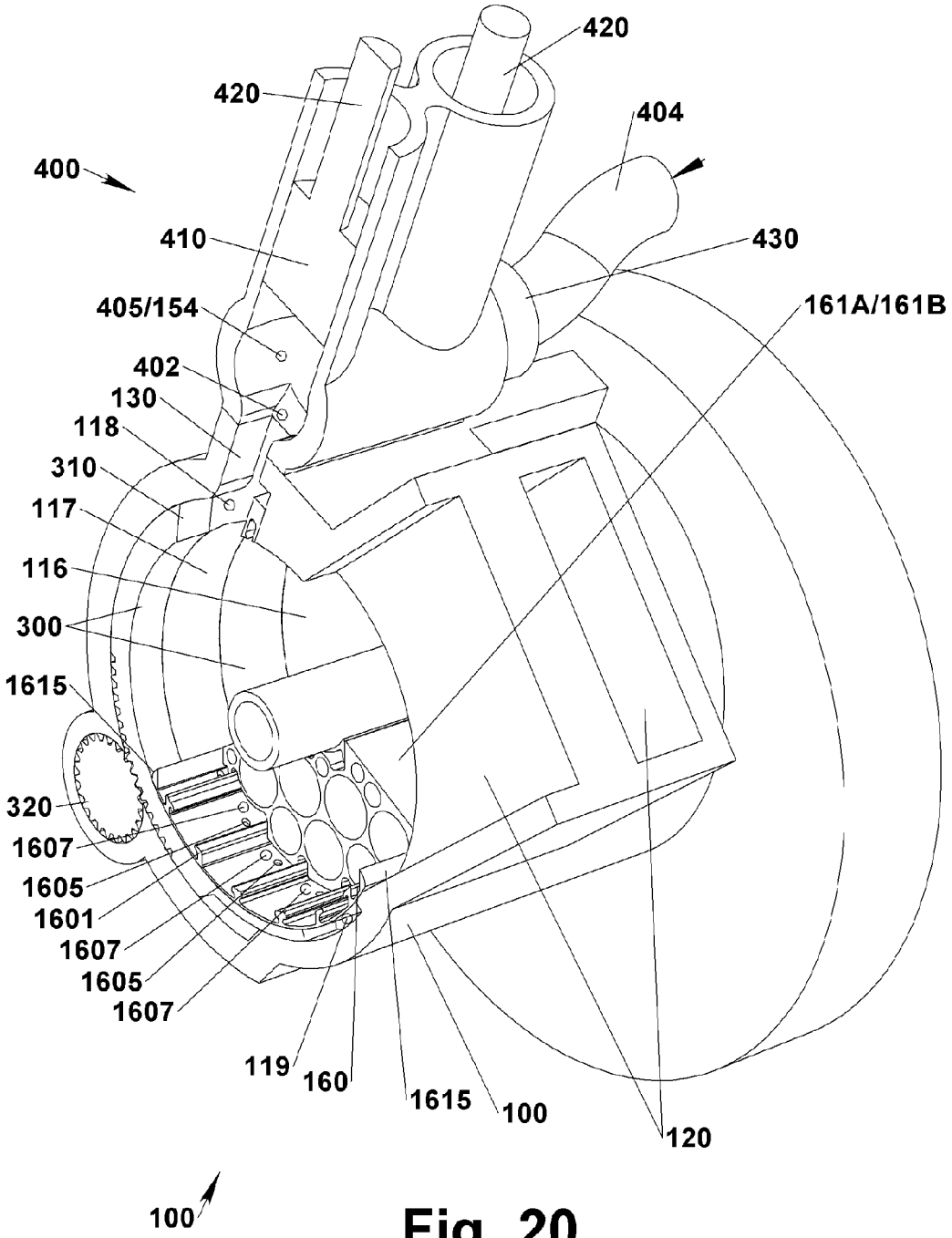
FIG. 20 is the first perspective cut view of the rotary piston device of a fourth embodiment of the invention.

Referring to FIG. 20, the circumferential chamber surface that is preferably the peripheral piston chamber wall 116 has circumferential rim(s) 117 axially in between the fluid access openings 120, 130 that provide radial support for the piston seal 160 or pistons 161A, 161B particularly in between the fluid access openings 120, 130. The optionally employed piston seal 160 may feature one or more radial through holes 1605 that are axially aligned with the circumferential rim(s) 117 and/or axially adjacent the fluid access openings 120, 130. The radial through holes 1605 are in communication with one or more pressure voids 1607 in between the seal profile and the respective rotary piston 161A, 161B. The pressure voids 1607 may contain also coolant and/or lubricant fluid, which may assist in sealing the pressure voids 1607. To adjust to the pressure condition particularly in high pressure fluid access 130, the pressure voids 1607 may receive pressurized operation fluid through the radial through holes 1605 in case the pressure in the high pressure fluid access 120 exceeds the centrifugal mass force of the piston seal 160 and the current pressure voids 1607 pressure to the extent that the piston seal 160 is forced radial inward and out of contact with the circumferential rims 117 or peripheral piston chamber 116. In that way, pressure contact of the seal profile 160 is automatically adjusted to a level necessary to provide continuous sealing contact of the seal profile 160 and reliable closure of the high pressure fluid access 130/130A/130B. Similar radial through holes 1605 may be employed on the center seal profile 163 in case of which the circumferential chamber surface is the central seal wall 144.

Radial recessed in the peripheral piston chamber wall 116 may be one or more circumferential grooves 118 in each of which a curved groove slider 300 is circumferentially slide able embedded. Each curved groove slider 300 has a limiter face 310/310A/310B that is circumferentially limiting fluid communication between the circumferential groove 118 and the primary piston chamber 114. The curved groove slider 310 may be actuated by an operational groove slider actuator 320, which may be for example a gear on a shaft engaging with peripheral gear teeth on the curved groove slider 300. The circumferential groove 118 may have a reduced height at its distal end and the curved groove slider 300 may be accordingly shaped. Remaining groove crevices 119 may be of small volume and be at a location close to the low pressure fluid access 120/120A/120B where they have minimal effect on the fluid pressure within the expanded work volumes 111A, 111B while they pass over the crevices 119. Part of the rotary pistons 161A, 161B in general or eventual part of employed piston seals 160 may be peripheral piston edge fillets 1615 that may be utilized preferably in the expansion stage 520 to improve pressurized combustion fluid passage into the work volumes 111BA, 111BB.

Circumferential grooves 118 and curved groove sliders 310 may be part of the rotary piston system 100 configured as compression stage 510 and/or expansion stage 520. When employed in a compression stage 510, operationally adjusting the angular extension of fluid communication may provide a variable compression ratio at which compressed operational fluid is passed on from the circumferential changing work volumes 111A, 111B as may be appreciated by anyone skilled in the art. When employed in an expansion stage 520, operationally adjusting the angular extension of fluid communication may provide variable fluid mass capacity and/or fluid expansion end pressure as may be appreciated by anyone skilled in the art. The adjustable limiter faces 310/310A/310B with their affiliated curved groove sliders 300 and operational groove slider actuators 320 may be employed in conjunction with the low pressure fluid accesses 120A and/or 120B but preferably with the high pressure fluid accesses 130A and/or 130B. There, their combined employment may provide an operationally adjustable fluid pressure and consequently fluid temperature in a combustion system 400 that is in fluid communication with a primary piston chamber 116 of the compression stage 510 and a primary piston chamber 116 of the expansion stage 520. This may be particularly advantageous in tuning the combustion in conjunction with varying combustion fuels, varying combustion processes, and varying load and speed conditions of a combustion engine 500 employing a compression stage 510 and a rotationally linked expansion stage 520.

Part of the combustion system 400 may be the high pressure compression stage 511 and high pressure expansion stage 521 as described above with regards to the secondary piston chamber 115, drive pistons 191/192 and radial guides 185/186. The compression stage 510 and high compression stage 511 may each have a compression ratio that differs less than forty percent but are preferably about equal. This in conjunction with an employed fluid cooler 155 may substantially reduce the power required to compress a gaseous fluid amount to a predetermined pressure at an final compression inlet 401 as may be well appreciated by anyone skilled in the art.

Figure 21:
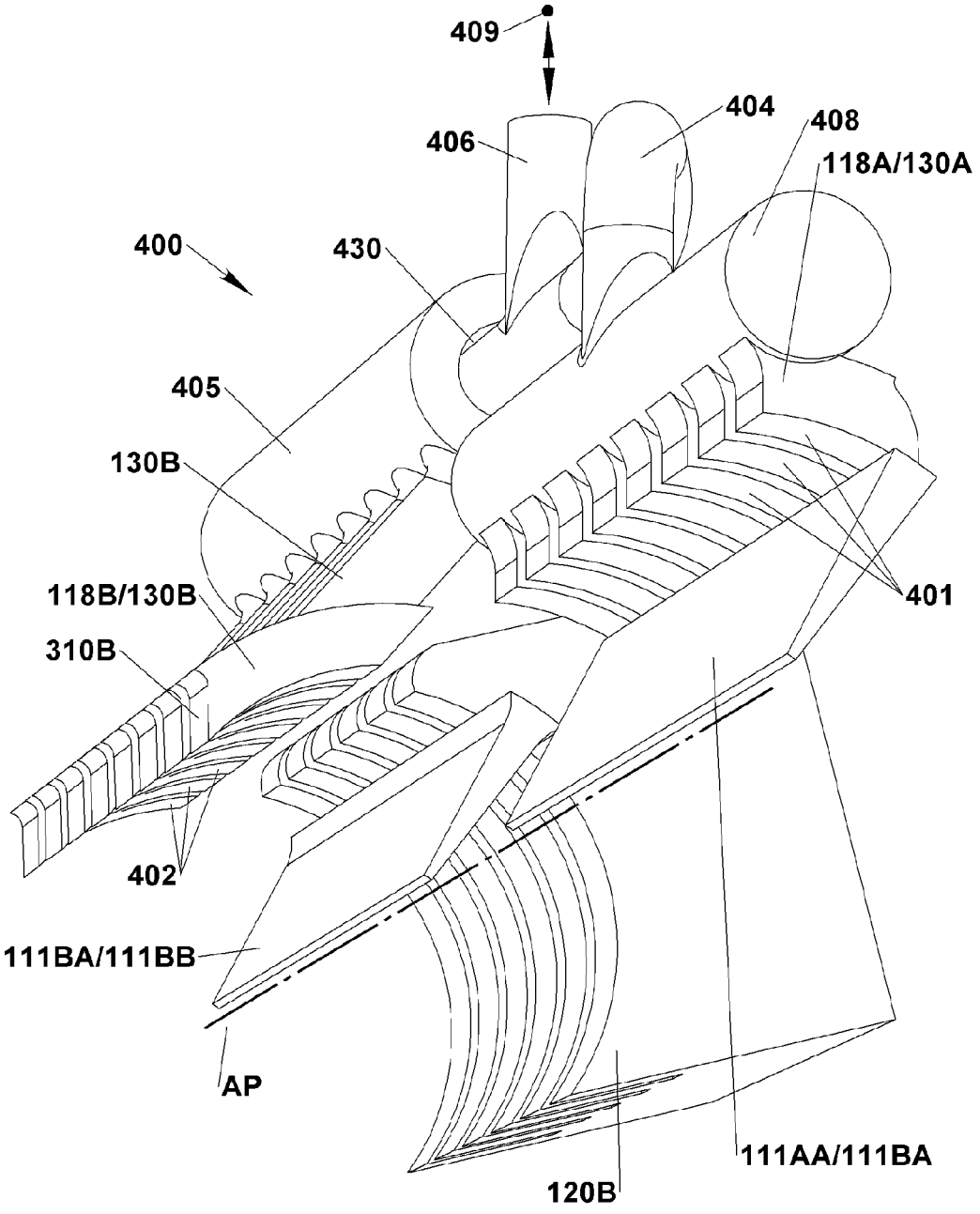
FIG. 21 is a fourth perspective view of a combustion system of a sixth embodiment of the invention together with expansion stage outlet, a single expansion stage volume during exhausting and a single compression stage volume at the begin of pressurized fluid transfer from the compression volume to the combustion system.
Figure 22:
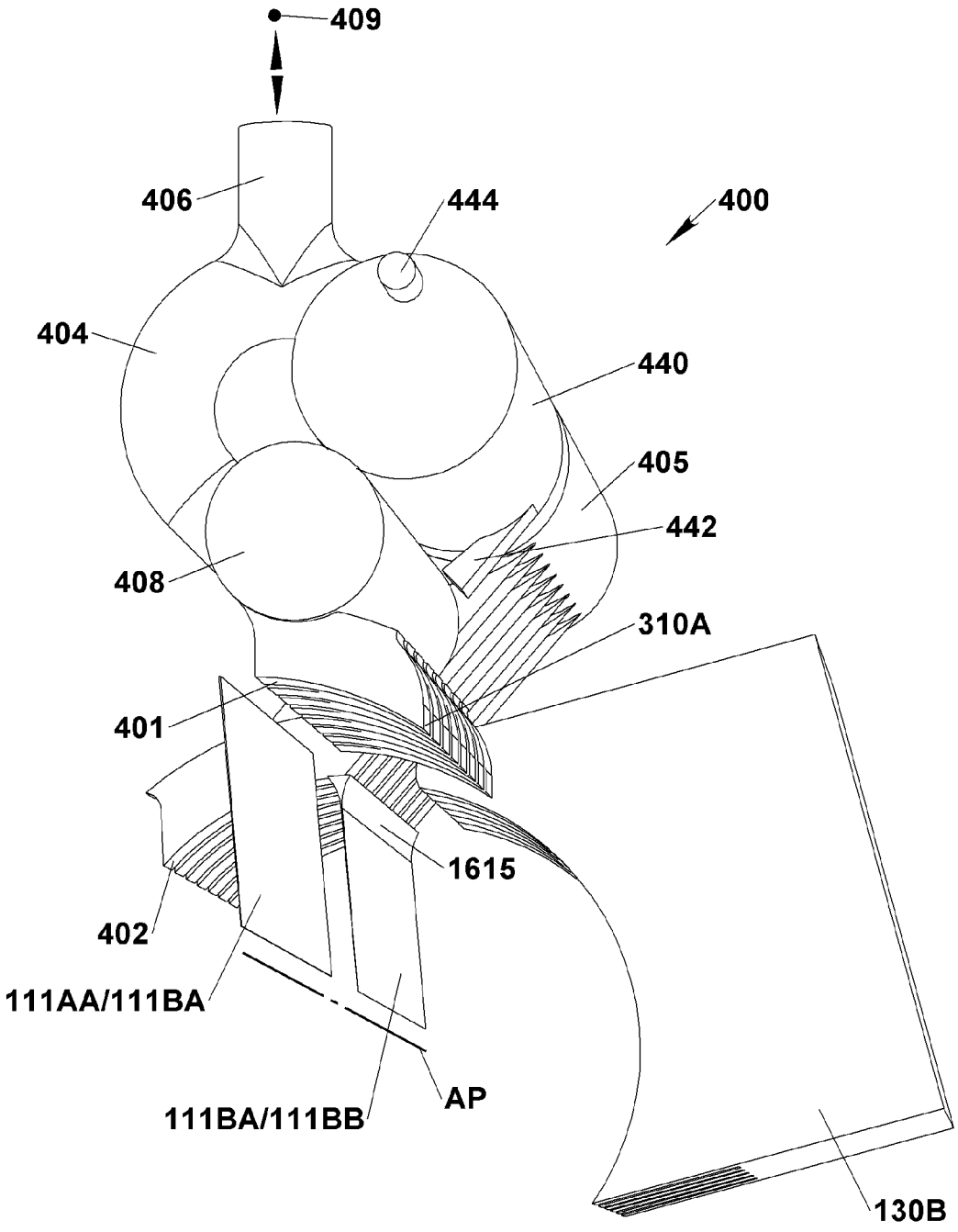
FIG. 22 is a fifth perspective view of a combustion system of a seventh embodiment of the invention together with an expansion stage outlet, a single expansion stage volume during initial combustion fluid reception and a single compression stage volume immediately after pressurized fluid transfer from the compression volume to the combustion system.
Figure 23A:
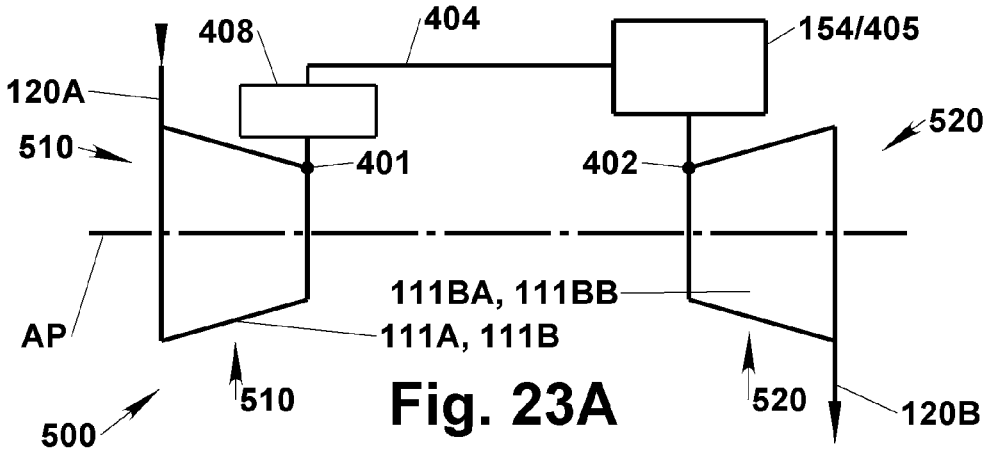
FIG. 23A depicts a schematic of a combustion system of a fifth embodiment of the invention.
Figure 23B:
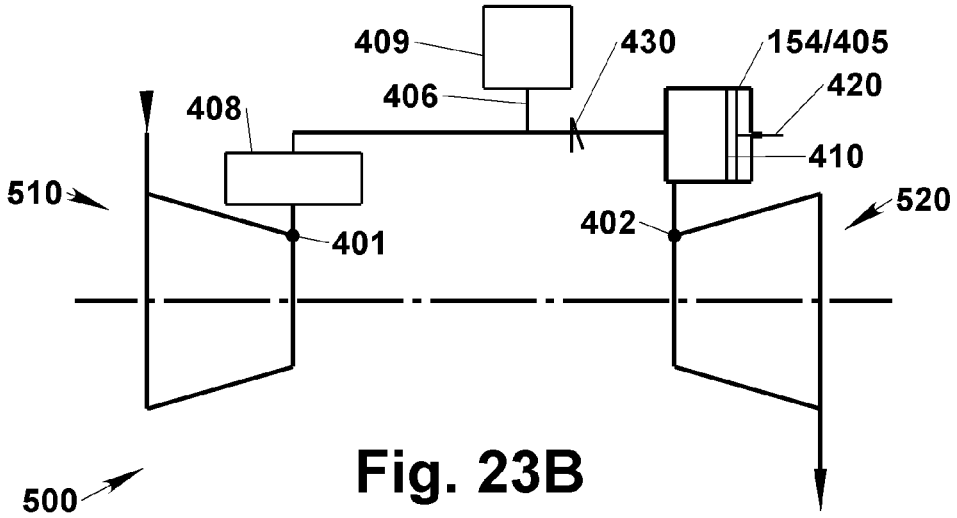
FIG. 23B depicts a schematic of the combustion system of the sixth embodiment of the invention.
Figure 23C:
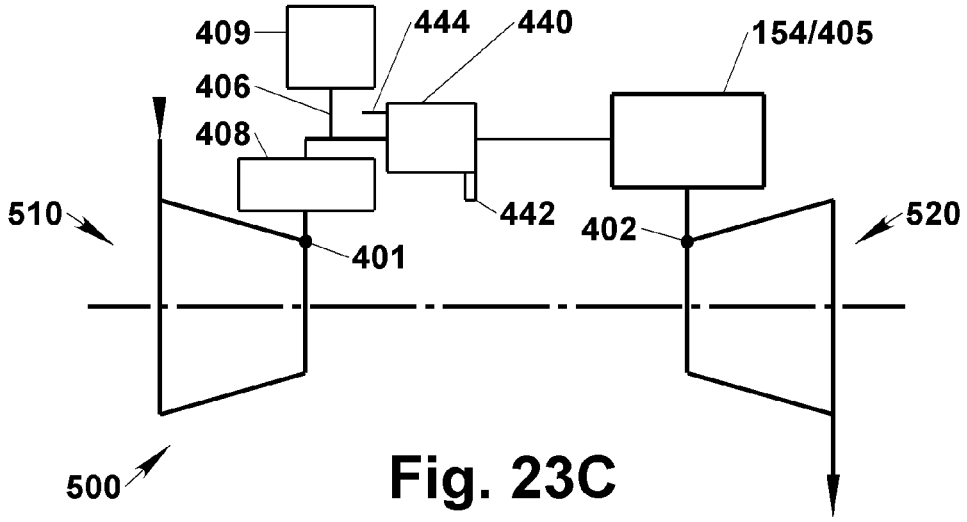
FIG. 23C depicts a schematic of the combustion system of the seventh embodiment of the invention.

As shown in FIGS. 21-23, further part of the combustion system 400 may be a combustion chamber 405 in between a final compression inlet 401 and an initial expansion outlet 402 similar as described for the fluid heating volume 154 and as depicted also in FIGS. 19A, 19B. Further part of the combustion system 400 may also be a back flow restricting valve 430 in between the combustion chamber 405 and the initial compression inlet 401. The back flow restricting valve 430 may be exposed only to unburned fluid passing through and therefore exposed to limited thermal loading only. The back flow restricting valve 430 may be configured as is well known for spring actuated compressor valves or may be mechanically, electrically, pneumatically and/or hydraulically actuated as is well known in the art. The back flow restricting valve 430 may also be employed to reduce eventual fluid pressure wave oscillations between final compression inlet 401 and initial expansion outlet 402.

Part of the combustion system 400 may also be a pressure container 409 in between the final compression inlet and the combustion chamber 405. Piping and tubing 404, 406 may provide fluid communication in between as is clear from the FIGS. 21-23. The pressure container 409 in conjunction with the adjustable limiter faces 310A and/or 310B may provide for brake energy harvesting in which during engine braking the compression stage 510 compresses more fluid than is combusted and expanded in the expansion stage 520.

Also part of the combustion system 400 may be a volume adjuster 410 such as a piston slide able sealing off the combustion chamber 405 towards the outside. The volume adjuster 410 may be actuated by an operational volume actuator 420 such as a connecting rod and any well known driving linkage to move the volume adjuster 410 while the engine 500 is operating. The volume adjuster in conjunction with the back flow restricting valve 430, the pressure container 409, and the adjustable limiter faces 310B or 310A together with 310B may provide for a burst mode engine operation during which more pressurized fluid may be combusted and pressure harvested in the expansion chamber 520 than provided by the compression stage 510 and eventually 511 as may be well appreciated by anyone skilled in the art.

As shown in FIGS. 21, 22, the compression stage 510 may feature a compression receive buffer 408 that may also be part of the combustion system 400 in case the compression stage 510 is employed in the combustion engine 500. The compression receive buffer 408 is immediately adjacent the circumferential piston chamber grooves 118A that act also as high pressure fluid access 130A. At high speeds of the compression stage 510, very little time is available for stagnant fluid in the vicinity of the final compression outlets 401 to accelerate when fluid is vacated from the work volumes 111AA, 111BA. The compression receive buffer 408 reduces pressure wave propagation length and consequently reduces peak pressures in the high pressure fluid access 130A in general and the circumferential grooves 118A in particular as may be well appreciated by anyone skilled in the art.

Absence of valves in the combustion system 400, in the expansion stage 520 and eventually in the high pressure expansion stage 521 as well as a self cleaning centrifugal effect in the rotating work volumes 111BA, 111BB and eventually 112A/112B/112C may be advantageously utilized to combust solid particle fuel and/or the evaporating content of solid particle fuel with low risk of particle clogging or build up. For that purpose, a particle fuel evaporator 440 may be part of the combustion system 400, in which the temperature of the compressed air or other gaseous operation fluid may be kept at a level such that the evaporating portion of the fuel particles is evaporated while keeping the temperature below self ignition of the particle vapors and/or the fuel particles. This may be facilitated by the limiter faces 310A inducing a varying compression end pressure and compression end temperature. In case of an employed high pressure compression stage 511, compression end temperature may be additionally or alternately controlled by the fluid cooler 155 as may be clear to anyone skilled in the art. The particle fuel evaporator 440 may feature a particle feed 444 and a carbon particle extraction port 442. The particle fuel evaporator 440 may have a cylindrical shape with a tangential inlet for a high internal fluid swirl and a centrifugal separation of particles and gas mixture that may be centrally exited. Due to the engine's 500 insensitivity to particle clogging or built up, particle separation may be of minor concern.

Fluid transfer timing at the final compression inlet 401 and at the initial expansion outlet 402 may be a consideration in optimizing the combustion process as is clear to anyone skilled in the art. Static fluid transfer timing may be provided by rotationally directly linking the secondary rotation axes AS of expansion stage 520 and compression stage 510, while positioning the primary rotation axes AP with respect to each other in an angle around the secondary rotation axis AS. In that way, final compression inlet 401 fluid transfer may be timely offset from initial expansion outlet 402 fluid transfer. In the special case depicted in the Figures, the primary rotation axes AP of compression stage 510 and expansion stage 520 are aligned resulting in synchronous timing of final compression inlet 401 fluid transfer and initial expansion outlet 402, which may suffice particular at high speeds where pressure propagation may sufficiently delay fluid pressure rise in the combustion chamber 405 as may be clear to anyone skilled in the art.

Figure 24A:
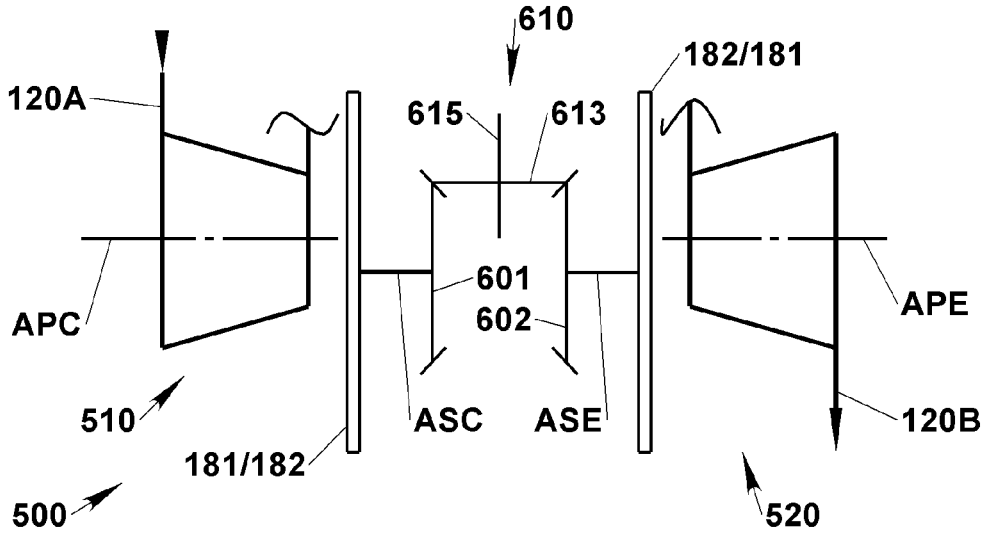
FIG. 24A depicts a schematic of a coaxial angle modulating gear linkage of the present invention.
Figure 24B:
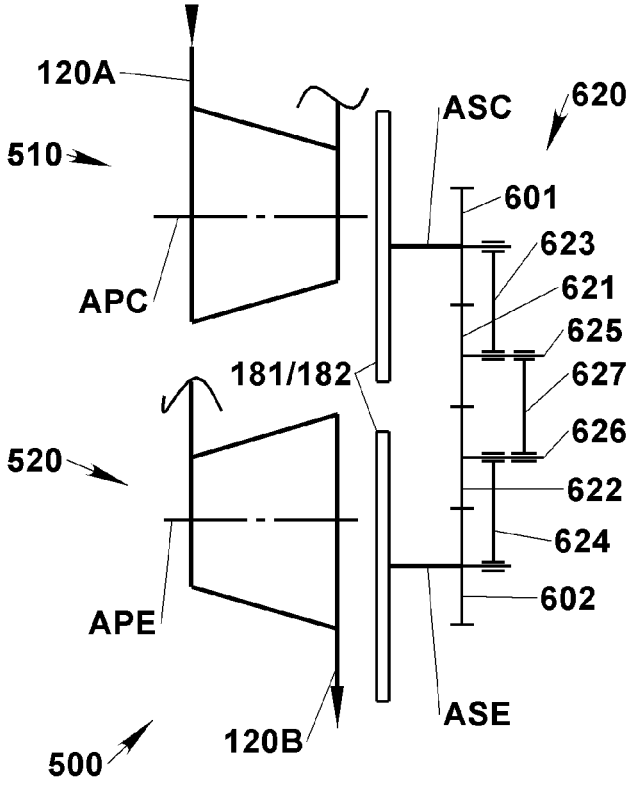
FIG. 24B depicts a schematic of an offset angle modulating gear linkage of the present invention.
Figure 24C:
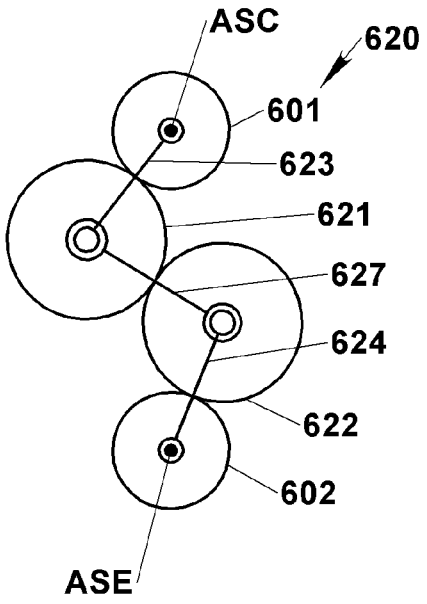
FIG. 24C is a schematic side view of the offset angle modulating gear linkage of FIG. 24B.
Figure 25:
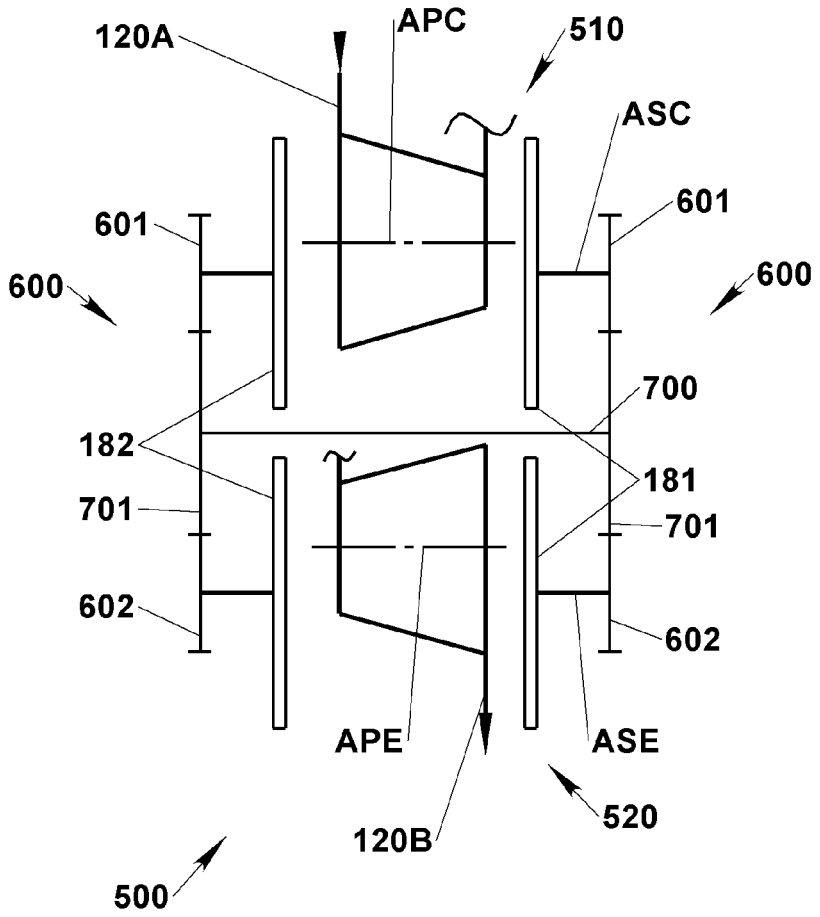
FIG. 25 depicts a schematic of a sync shaft gear linkage of the present invention.

Referring to FIGS. 24, 25, optional employment of an intermediate gear transmission 600/601/602 that is gear coupled with at least one flywheel 181/182 of the compression stage 510 and with at least one flywheel 181/182 of the expansion stage 520 may provide for an operational adjustment of fluid transfer timing between final compression inlet 401 and initial expansion outlet 402. In an embodiment depicted in FIG. 24A in which the secondary rotation axes ASC, ASE of compression stage 510 and expansion stage 520 are coaxial, the intermediated gear transmission may be configured as a coaxial angle modulating gear linkage 610. The coaxial angle modulating gear linkage 610 has at least one orthogonal link gear 613 that is engaging with a compression stage gear 601 and an expansion stage gear 602. The orthogonal link gear 613 is rotationally held in a planetary swivel shaft 615 that is operationally rotate able around the coaxial secondary rotation axes ASC, ASE. As the planetary swivel shaft 615 is rotated, the angular position of compression stage flywheels 181/182 changes with respect to the expansion stage flywheels 181/182 and so does the fluid transfer timing at the final compression inlet 401 with respect to the initial expansion outlet 402.

As shown in FIGS. 24B, 24C, the secondary compression stage axis ASC may be in an offset to the secondary expansion stage axis ASE. In that case, the intermediate gear transmission may be configured as an offset angle modulating gear linkage 620 that features an expansion stage swivel gear 622 engaging with the expansion stage gear 602, and a compression stage swivel gear 621 that engages with the compression stage gear 601. The expansion stage swivel gear 622 and the compression stage swivel gear 621 engage with each other as well and are operationally swivel able around their respective secondary rotation axes ASE, ASC via their respective compression stage swivel 623, expansion stage swivel 624 and swivel link 627.

By employing the intermediate gear linkage 600/601/602, primary compression stage axis APC may be in offset to primary expansion stage axis APE. As depicted in FIG. 25, the intermediate gear transmission 600 may feature a sync shaft gear 701 that is engaging with the compression stage gear 601 and the expansion stage gear 602 and that is coupled with a sync shaft 700. Intermediate gear transmissions 600 may be placed on both axial ends of compression stage 510 and expansion stage 520 and the opposing flywheels 181, 182 may be torque transmitting coupled via the sync shaft 700.

The compression stage 510 may be scaled such that an overall compression volume of it is substantially smaller than an overall expansion volume of the expansion stage 520, which may provide for extended pressure harvesting of the combusted fluid while combustion stage 510 and expansion stage rotate 520 at the same speed and while taking advantage of timed fluid transfer between final compression outlet 401 and initial expansion inlet 402 as may be well appreciated by anyone skilled in the art. Overall compression and expansion volumes are the volume differences of all rotating work volumes in a primary piston chamber 114 at their maximum and their minimum in the respective compression or expansion stage 510/520. Additionally or alternately, multiple expansion stages 520 may be rotationally linked in an engine 500 and may be selectively accessed to the combustion system 400 by use of the limiter faces 310B to completely shut of individual initial expansion outlets 402. This may be also advantageously utilized for part load operation of the engine 500 as may be well appreciated by anyone skilled in the art.

The below nomenclature is included as reference. Numerals in the Specification and Figures may have a letter extension where multiples of the same or similar components are numerically referenced and identified.

100 Rotary piston device
110 Housing
111 Circumferential changing work volumes
112 Radial changing work volumes
114/115 Primary/Secondary Piston chamber
116 Peripheral primary piston chamber wall
117 Circumferential rim
118 Circumferential groove
119 Groove crevice

120 Low pressure fluid access
130 High pressure fluid access
140 Center tube
142 Center tube hole
144 Central seal wall
145 Circumferential assembly supply holes
148 Driving piston supply holes
150 Fluid transfer housing
151 Single stage transfer channel
152 Compression stage transfer channel
153 Combustion stage transfer channel
154 Fluid heating volume
155 Fluid cooler
156 Secondary heating volume
158 Exhaustion stage transfer channel
160 Peripheral seal profile
1601 Stiffening rib
1602 Radial pin holes
1605 Radial through hole
1607 Pressure void
1615 Peripheral piston edge fillet
161 Rotary pistons
1612 Through holes
163 Center seal profile
164 Center face
165 Piston faces
166 Peripheral piston face
167 Axial fluid hole
168 Circumferential lubrication grooves
1681 Radial lubrication groove access holes
169 Radial spring profile
1691, 1692 Two opposing axial piston ends
1693 Piston end seal lips
170 Piston slider
181, 182 Fly wheels
184 Flywheel bearings
185/186 Primary/secondary radial guides
191/192 Primary/secondary drive pistons
195 Central drive piston
193/194 Primary/secondary radial piston faces
196 Center piston face
200 Rotary assembly
211, 212 primary/secondary crank disk
2121 Center tube hole
213, 214 Primary/Secondary bearing disk
215, 216 Primary/secondary axial piston coupling
2161 Coupling protrusions
217, 218 Chamber seal faces
219, 220 Coupling seal faces
223, 224 Radial seal faces
225 Peripheral seal face
226 Central disk seal face
231, 232 Primary/secondary crank joint
233 Central crank joint
241 Disk interconnect bearing
242 Disk housing bearing
251 Radial supply channel
252 Radial drain channel
185-191-231-211-215/186-192-232-212-216 Primary/Secondary kinetic linkage
300 Curved groove slider
310 Limiter face
320 Operational groove slider actuator
400 Combustion system
401 Final compression inlet
402 Initial expansion outlet
404 Feed tube
405 Combustion chamber
406 Pressure Container connect tube
408 Compression receive buffer
409 Burst power pressure container
410 Volume adjuster
420 Operational volume actuator
430 Back flow restricting valve
440 Particle fuel evaporator
442 Carbon particle extraction port
444 Particle fuel feed
500 Combustion engine
510 Compression stage
520 Expansion stage
600 Intermediate gear transmission
601 compression stage gear
602 expansion stage gear
610 Coaxial angle modulating gear linkage
613 Orthogonal link gear
615 Planetary gear shaft
620 Offset angle modulating gear linkage
621 Compression stage swivel gear
622 Expansion stage swivel gear
623 Compression stage swivel
624 Expansion stage swivel
625 Compression stage swivel gear shaft
626 Expansion stage swivel gear shaft
627 Swivel link
700 Sync shaft
701 Sync shaft gear
AP Primary rotation axis
AS Secondary rotation axis
AT Tertiary rotation axis
PL Axis plane
MC Combined mass center
OP Primary offset
OS Secondary offset
OT Tertiary offset
ACC1, ACC2 Angular rotary piston accelerations
ACCDIF Acceleration difference
SPD1, SPD2 Angular rotary piston speeds
SPDAVE Average and flywheel speed
TTR1, TTR2 Kinetic linkage transmission ratios
TRRDIF Transmission ratio difference
T1, T2, T3, T4, T5 Timelines Accordingly, the scope of the invention as described in the Figures and the Specification above is set forth by the following claims and their legal equivalent:

What is claimed is:

1. A rotary piston device comprising:

A. a rotary piston chamber of at least one of a compression stage and an expansion stage of said rotary piston device;

B. a rotary piston being circumferentially undulating rotatable held within said rotary piston chamber such that at least one of a compression volume in said compression stage and an expansion volume in said expansion stage is alternating circumferentially expanding and contracting while said rotary piston is circumferentially undulating rotating;

C. a fluid access adjacent said rotary piston chamber;

D. a circumferential groove that is radial recessed in a peripheral wall of said rotary piston chamber and that is in fluid communication with said fluid access;

E. a curved groove slider slide able embedded in said circumferential groove;

F. a limiter face on a circumferential end of said curved groove slider; and wherein said limiter face is circumferentially limiting a compressible fluid communication between said fluid access and said rotary piston chamber such that:

1. an angular extension of fluid communication between said rotary piston chamber and said fluid access is operationally adjustable via said curved groove slider and said limiter face; and 2. at least one of a compression ratio for said compression stage and a fluid expansion for said expansion stage are adjustable by said curved groove slider.

2. The rotary piston device of claim 1 comprising: a peripheral piston edge fillet that is positioned along a circumferential edge of said rotary piston.

3. The rotary piston device of claim 1, further comprising a pressure container in fluid communication with said rotary piston chamber via at least a piping and a tubing for at least one of a brake energy harvesting and a burst mode engine operation of said rotary piston device.

4. A combustion engine comprising:

A. a rotary piston compression stage comprising a primary rotary piston assembly undulating rotatable linked to a first flywheel rotating around a first flywheel axis;

B. a rotary piston expansion stage comprising a secondary rotary piston assembly undulating rotatable linked to a second flywheel rotating around a second flywheel axis; and C. an intermediate gear transmission that is gear coupled to said first flywheel and said second flywheel, said intermediate gear transmission comprising a swivel gear that is capable of being operationally swiveled around at least one of said first flywheel axis and said second flywheel axis such that an angular position between said first flywheel and said second flywheel is changed, such that an angular offset between said rotary compression stage and said rotary expansion stage is provided variable; and such that a fluid transfer timing between said compression stage and said expansion stage is operationally adjustable.

5. The combustion engine of claim 4, further comprising a back flow restriction valve in between said compression stage and said expansion stage.

6. The combustion engine of claim 4, wherein at least one of said primary and said secondary rotary piston assemblies comprises a rotary piston, and wherein said rotary piston comprises a peripheral piston edge fillet that is positioned along a circumferential edge of said rotary piston.

* * * * *